US011061345B2

(12) United States Patent
Satoh et al.

(10) Patent No.: US 11,061,345 B2
(45) Date of Patent: Jul. 13, 2021

(54) TONER, TONER STORED UNIT, DEVELOPER, DEVELOPER STORED UNIT, AND IMAGE FORMING APPARATUS

(71) Applicants: Kohsuke Satoh, Shizuoka (JP); Tsuneyasu Nagatomo, Shizuoka (JP); Keiji Makabe, Shizuoka (JP); Daichi Hisakuni, Shizuoka (JP)

(72) Inventors: Kohsuke Satoh, Shizuoka (JP); Tsuneyasu Nagatomo, Shizuoka (JP); Keiji Makabe, Shizuoka (JP); Daichi Hisakuni, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/798,977

(22) Filed: Feb. 24, 2020

(65) Prior Publication Data

US 2020/0272066 A1 Aug. 27, 2020

(30) Foreign Application Priority Data

Feb. 26, 2019 (JP) ..... JP2019-032823

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 9/113*** | (2006.01) |
| ***G03G 15/08*** | (2006.01) |

(52) U.S. Cl.

CPC ..... *G03G 9/09708* (2013.01); *G03G 9/0819* (2013.01); *G03G 9/0825* (2013.01); *G03G 9/08711* (2013.01); *G03G 9/08755* (2013.01); *G03G 9/113* (2013.01); *G03G 15/0865* (2013.01)

(58) Field of Classification Search

CPC ..... G03G 9/09708; G03G 9/0825

USPC ..... 430/108.11, 108.3

See application file for complete search history.

(56) References Cited

U.S. PATENT DOCUMENTS

| | | | | |
|---|---|---|---|---|
| 2001/0028988 | A1 | 10/2001 | Magome et al. | |
| 2003/0165759 | A1* | 9/2003 | Suzuki | G03G 9/0827 430/108.4 |
| 2005/0048386 | A1* | 3/2005 | Kato | G03G 9/0836 430/106.1 |
| 2010/0261111 | A1 | 10/2010 | Aruga et al. | |
| 2010/0261112 | A1 | 10/2010 | Aruga et al. | |
| 2013/0157193 | A1 | 6/2013 | Moritani et al. | |

(Continued)

FOREIGN PATENT DOCUMENTS

| | | |
|---|---|---|
| EP | 0498942 A1 | 8/1992 |
| EP | 1 128 225 A2 | 8/2001 |

(Continued)

OTHER PUBLICATIONS

U.S. Appl. No. 16/583,861, filed Sep. 26, 2019.

(Continued)

*Primary Examiner* — Mark A Chapman

(74) *Attorney, Agent, or Firm* — Oblon, McClelland, Maier & Neustadt, L.L.P.

(57) ABSTRACT

A toner including toner particles, each toner particle including a toner base particle, and inorganic particles, wherein the inorganic particles include particles of a fluorine-containing aluminium compound, and a liberation ratio of the inorganic particles is 10% or greater but 60% or less.

12 Claims, 4 Drawing Sheets

(56) References Cited

U.S. PATENT DOCUMENTS

| | | | | |
|---|---|---|---|---|
| 2014/0220485 | A1 | 8/2014 | Kojima et al. | |
| 2016/0266507 | A1 | 9/2016 | Watanabe et al. | |
| 2016/0334722 | A1 | 11/2016 | Makabe et al. | |
| 2018/0181014 | A1 | 6/2018 | Makabe et al. | |
| 2018/0224763 | A1 | 8/2018 | Tanaka et al. | |
| 2019/0278191 | A1* | 9/2019 | Suzuki | G03G 9/09708 |

FOREIGN PATENT DOCUMENTS

| | | | |
|---|---|---|---|
| JP | 2988085 | | 10/1999 |
| JP | 2003-280253 | | 10/2003 |
| JP | 2004-352591 | A | 12/2004 |
| JP | 2006-215532 | | 8/2006 |
| JP | 2009-169150 | | 7/2009 |
| JP | 2010-19890 | A | 1/2010 |
| JP | 2010-249987 | | 11/2010 |
| JP | 2010-249989 | | 11/2010 |
| JP | 2011-145497 | | 7/2011 |
| JP | 2013-145369 | | 7/2013 |
| JP | 2014-164034 | | 9/2014 |

OTHER PUBLICATIONS

U.S. Appl. No. 16/569,279, filed Sep. 12, 2019.
Extended European Search Report dated Jun. 8, 2020 in European Patent Application No. 20158855.5, citing documents AA, AB, and AO-AQ therein, 7 pages.

* cited by examiner

TONER, TONER STORED UNIT, DEVELOPER, DEVELOPER STORED UNIT, AND IMAGE FORMING APPARATUS

CROSS-REFERENCE TO RELATED APPLICATIONS

The present application claims priority under 35 U.S.C. § 119 to Japanese Patent Application No. 2019-032823 filed Feb. 26, 2019. The contents of which are incorporated herein by reference in their entirety.

BACKGROUND OF THE INVENTION

Field of the Invention

The present disclosure relates to a toner, a toner stored unit, a developer, a developer stored unit, and an image forming apparatus.

Description of the Related Art

For image formation according to an electrophotographic system, a so-called two-component developing system, where friction charging performed by stirring and mixing a toner and a carrier, has been widely used.

Factors for deteriorations of a two-component developer used such a two-component developing system include abrasion or peeling of a resin coating layer disposed on a surface of each carrier particle, crushing of carrier particles, reduction in charging performance due to spent of a toner particle component on carrier particles, a change from desired electric resistance, and generation of fragments and wear debris. Because of these factors, deteriorations of image quality, such as low image density, generation of background fogging, and low resolution, and deteriorations of an image formation system, such as generation or physical or electrical damages on an image bearer, and contamination of a charging member, may be caused.

Therefore, extension of service life of a two-component developer and improvement of durability of a two-component developer have been attempted. For example, proposed is a toner which includes number of base particles, and number of particles of an external additive, where the external additive includes at least a charge-imparting external additive configured to charge the base particles, and the charging-imparting external additive is set to have a liberation ratio of from 0.5% through 8%, the liberation ratio being a ratio of the free external additive that is not deposited on the base particles (see, for example, Japanese Unexamined Patent Publication No. 2013-145369).

SUMMARY OF THE INVENTION

According to one aspect of the present disclosure, a toner includes toner particles. Each toner particle includes a toner base particle and inorganic particles. The inorganic particles include particles of a fluorine-containing aluminium compound. A liberation ratio of the inorganic particles is 10% or greater but 60% or less.

DESCRIPTION OF THE EMBODIMENTS (Toner)

Figure 1:
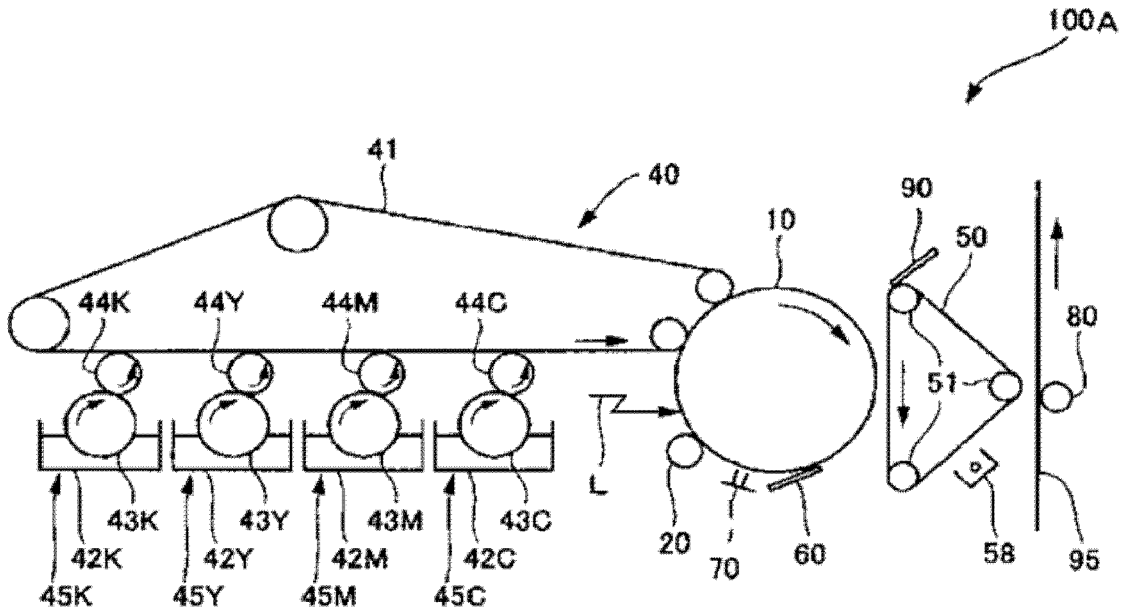
FIG. 1 a schematic view illustrating an example of an image forming apparatus of the present disclosure.

A toner of the present disclosure includes toner particles. Each toner particle includes a toner base particle and inorganic particles. The inorganic particles include particles of a fluorine-containing aluminium compound and a liberation ratio of the inorganic particles is 10% or greater but 60% or less. The toner may further include other components according to the necessity.

The present invention has an object to provide a toner, which has stable chargeability over a long period of time with maintaining excellent heat resistant storage stability, prevents fluctuations in charging due to an environment, prevents contamination inside a device due to toner scattering, and does not cause filming of a photoconductor.

The present invention can provide a toner, which has stable chargeability over a long period of time with maintaining excellent heat resistant storage stability, prevents fluctuations in charging due to an environment, prevents contamination inside a device due to toner scattering, and does not cause filming of a photoconductor.

In the art, alumina used as inorganic particles of a toner is insufficient in chargeability. Moreover, there is a problem that it is difficult to achieve all of chargeability of a toner, definite prevention of filming of a photoconductor and damages of a photoconductor, and a prolonged service life of a photoconductor at the same time.

Since the toner of the present disclosure includes toner bae particles and inorganic particles and the inorganic particles include particles of a fluorine-containing aluminium compound, negative chargeability of a toner is improved to improve chargeability of the toner. Therefore, charge stability of the toner is improved, and toner scattering (contamination inside a device with the toner) can be prevented.

Moreover, the fluorine-containing aluminium compound is extremely effective for charge stability in various environment without lowering an ability of imparting flowability, and can impart excellent heat resistance storage stability to a resultant toner as surfaces of toner particles can be made hard.

When a large amount of inorganic particles are detached to be free from toner base particles, typically chargeability of a toner may not be stable. Since the inorganic particles used in the toner of the present disclosure include particles of a fluorine-containing aluminium compound, a liberation ratio of the inorganic particles can be made high while chargeability of the toner is stabilized, and therefore both charge stability and abrasiveness can be obtained.

The toner of the present disclosure includes toner base particles, each of which includes a toner base particle and inorganic particles, and may further include other components according to the necessity.

<Inorganic Particles>

The inorganic particles include particles of a fluorine-containing aluminium compound, preferably further include particles of a silicon compound, and may further include other particles according to the necessity.

In the present disclosure, liberation ratio of the inorganic particles is 10% or greater but 60% or less, and preferably 15% or greater but 55% or less.

When the liberation ratio of the inorganic particles is 10% or greater, it is difficult for the inorganic particles to be embedded in a toner base particle, and therefore excellent image quality is maintained over time. When the liberation ratio of the inorganic particles is 60% or less, it is difficult for the inorganic particles to detach from a toner base particle, and therefore excellent image quality is maintained over time.

The liberation ratio of the inorganic particles can be measured in the following manner.

(1) First, 5 g of NOIGEN (ET-165, dispersion medium: water, available from DKS Co., Ltd.) is weighed in a 500 mL beaker. To the beaker, 30 mL of distilled water is added. Ultrasonic waves are applied to the resultant to dissolve NOIGEN. The resultant is transferred into a 1,000 mL volumetric flask and then is diluted (in the case that air bubbles were generated, the resultant was left to stand for a while). The resultant is made homogenous by applying ultrasonic waves, to thereby prepare a 0.5% by mass NOIGEN dispersion liquid.

(2) Next, 50 mL of the 0.5% by mass NOIGEN dispersion liquid and 3.75 g of the toner are added to a 100 mL screw vial, and the resultant mixture is mixed for 30 minutes by means of a ball mill.

(3) Next, ultrasonic energy is applied to the resultant for 1 minute by means of an ultrasonic homogenizer (device name: homogenizer, type: VCX750, CV33, available from Sonics & Materials, Inc.) with setting a dial to output of 50% under the following conditions to disperse the mixture.

—Ultrasonic Wave Conditions—

Vibration duration: continuous 60 seconds

Amplitude: 40 W (50%)

Temperature: 25° C.

(4) Next, the obtained dispersion liquid is subjected to vacuum filtration with filter paper (product name: No. 5C, available from Advantec Toyo Kaisha, Ltd.). The resultant is washed twice with ion-exchanged water, followed by performing filtration. After removing the free inorganic particles that has been detached from the toner base particles, the toner is dried.

(5) A mass of the inorganic particles before and after removing the inorganic particles is measured by calculating a mass (% by mass) from the intensity (or a difference in the intensity before and after removing the inorganic particles) on a calibration curve by means of an X-ray fluorescence spectrometer (ZSX Primus IV, available from Rigaku Corporation).

The silica and alumina of the toner are determined by X-ray fluorescence spectroscopy.

In the present disclosure, the amount (% by mass) of the silica and the amount (% by mass) of the alumina are determined by the following device under the following conditions in the present disclosure.

A toner (3.00 g) is formed into a pellet having a diameter of 3 mm and a thickness of 2 mm, to thereby prepare a measurement sample toner.

Next, an amount of the Si element and an amount of the Al element in the pellet sample are measured by quantitative analysis performed by means of an X-ray fluorescence spectrometer. At the time of measurement, collection is performed using silica and alumina standard samples (available from Rigaku Corporation) to calculate the amounts of the silica and alumina.

Measuring device: ZSX Primus IV, available from Rigaku Corporation

X-ray tube: Rh

X-ray tube voltage: 50 kV

X-ray tube current: 10 mA

Next, a liberation ratio (%) of the inorganic particles can be determined from the mass of the inorganic particles of the toner before and after the dispersion measured by (1) to (5) above according to the mathematical formula 1 below.

Liberation ratio (%) of inorganic particles=[(mass of inorganic particles before dispersion−mass of residual inorganic particles after dispersion)/mass of inorganic particles before dispersion]×100 [Mathematical Formula 1]

<<Fluorine-Containing Aluminium Compound>>

Examples of the fluorine-containing aluminium compound include an aluminium compound treated with a fluorine compound. Examples of the aluminium compound include alumina.

Examples of the fluorine compound include a fluorine-containing silane compound.

As the fluorine-containing silane compound, a silane compound obtained by substituting a hydrogen atom of an alkyl group with a fluorine atom can be used. For example, a compound represented by the following general formula can be used.

$$(Rf_1)a(R_1)_bSi(X)_c \qquad \text{General Formula (1)}$$

$Rf_1$ is a fluorine-containing alkyl group having from 1 through 20 carbon atoms, which may include one or more ether bonds or one or more ester bonds, $R_1$ is an alkyl group having from 1 through 10 carbon atoms, X is an alkoxy group, a halogen atom, or $R_2COO$, where $R_2$ is a hydrogen atom or an alkyl group having from 1 through 10 carbon atoms, a, b, and c satisfy a+b+c=4, where a and c are each an integer of from 1 through 3, and b is an integer of from 0 through 2.

In General Formula (1), $Rf_1$ is a fluorine-containing alkyl group having from 1 through 20 carbon atoms (may include one or more ether bonds or one or more ester bonds), and examples thereof include a 3,3,3-trifluoropropyl group, a tridecafluoro-1,1,2,2-tetrahydrooctyl group, a 3,3,3-trifluoromethoxypropyl group, and a 3,3,3-trifluoroacetoxypropyl group.

$R_1$ is an alkyl group having from 1 through 10 carbon atom, and is the alkyl group free from fluorine. Examples of the alkyl group include a methyl group, an ethyl group, and a cyclohexyl group.

X is an alkoxy group, where an alkyl group of the alkoxy group may include a substituent, such as a fluorine atom, and the number of carbon atoms thereof is preferably from 1 through 10 and more preferably 1 or 2. Examples of the alkoxy group include a methoxy group, an ethoxy group, and a 2,2,2-trifluoroethoxy group.

Examples of the halogen atom include Cl, Br, and I.

Examples of $R_2COO$ (with the proviso that $R_2$ is a hydrogen atom or an alkyl group having from 1 through 10 carbon atoms, where the alkyl group may include a substituent, such as a fluorine atom, and the alkyl group is preferably an alkyl group having from 1 through 10 carbon atoms, and more preferably an alkyl group having 1 or 2 carbon atoms) include $CH_3COO$, $C_2H_5COO$, and $CF_3CH_2COO$.

a, b, and c satisfy a+b+c=4, where a and c are each an integer of from 1 through 3, and b is an integer of from 0 through 2.

Specific examples of the fluorine-containing silane compound represented by General Formula (1) include heptadecafluorodecyltrimethoxysilane, trifluoropropyltrimethoxysilane, triethoxytridecafluoro-n-octylsilane, triethoxyperfluorohexylsilane, triethoxyperfluorodecylsilane, trimethoxyperfluorodecylsilane, and trimethoxyperfluorohexylsilane. The above-listed examples may be used alone or in combination.

A number average particle diameter of the particles of the fluorine-containing aluminium compound is preferably 10 nm or greater but 30 nm or less, and more preferably 15 nm or greater but 25 nm or less.

When the number average particle diameter of the particles of the fluorine-containing aluminium compound is 10 nm or greater, excellent durability is obtained, and it is difficult for the particles of the fluorine-containing aluminium compound to be embedded in a toner base particle, and therefore excellent quality is maintained over time. When the number average particle diameter of the particles of the fluorine-containing aluminium compound is 30 nm or less, moreover, it is difficult for the particles of the fluorine-containing aluminium compound to be detached from a toner base particle, and therefore a resultant toner has excellent chargeability.

The number average particle diameter of the particles of the fluorine-containing aluminium compound can be measured by obtaining a SEM image of the particles of the fluorine-containing aluminium compound, for example, using a field emission scanning electron microscope (FE-SEM) (SU8230, available from Hitachi High-Technologies Corporation), and measuring the number average particle diameter through image analysis.

First, the particles of the fluorine-containing aluminium compound are dispersed in tetrahydrofuran, followed by removing the solvent to dry and solidify on a substrate. The resultant sample is observed under the FE-SEM to obtain an image, and the maximum length of each of secondary particles is measured. An average value of the 200 particles is calculated and is determined as the number average particle diameter. The measuring conditions of the FE-SEM are as follows.

[Measuring Conditions of FE-SEM]
Acceleration voltage: 2.0 kV
Working distance (WD): 10.0 mm
Observation magnification: 50,000 times A liberation ratio of the particles of the fluorine-containing aluminium compound is preferably 10% or greater but 20% or less, and more preferably 12% or greater but 18% or less.

When the liberation ratio of the particles of the fluorine-containing aluminium compound is 10% or greater, a sufficient polishing effect of the particles of the fluorine-containing aluminium compound can be obtained. When the liberation ratio of the particles of the fluorine-containing aluminium compound is 20% or less, moreover, an appropriate polishing effect of the particles of the fluorine-containing aluminium compound can be obtained, a charging effect of the particles of the fluorine-containing aluminium compound is exhibited, and therefore a resultant toner has excellent chargeability.

For example, the liberation ratio of the fluorine-containing aluminium compound can be measured in the same manner as the measurement method of the liberation ratio of the inorganic particles. In the case where the inorganic particles include the particles of the fluorine-containing aluminium compound and another inorganic particles (e.g., silica particles), the liberation ratio of the particles of the fluorine-containing aluminium compound can be determined by calculating mass (% by mass) of Al before and after removing another inorganic particles from the intensity on a calibration curve by means of a X-ray fluorescence spectrometer.

A ratio (major axis diameter/minor axis diameter) of a major axis diameter of each of the particles of the fluorine-containing aluminium compound to a minor axis diameter of each of the particles of the fluorine-containing aluminium compound is preferably 1.0 or greater but 1.3 or less.

When the ratio (major axis diameter/minor axis diameter) of each of the particles of the fluorine-containing aluminium compound is 1.3 or less, a shape of the particle of the fluorine-containing aluminium compound is substantially sphere, and an excellent polishing effect can be obtained. When the ratio (major axis diameter/minor axis diameter) of each of the particles of the fluorine-containing aluminium compound is greater than 1.3, a shape of the particle of the fluorine-containing aluminium compound is a rod shape or a needle shape, and therefore a contact area increases and the particles may be stuck in a photoconductor or carrier particles due to the shape thereof, and as a result, the particles may adversely affect a quality of a resultant image. When the particles of the fluorine-containing aluminium compound are deposited in the state where the particles are also inserted into toner base particles, moreover, a covering rate decreases, and for example, heat resistant storage stability may be decreased.

The ratio (major axis diameter/minor axis diameter) of each of the particles of the fluorine-containing aluminium compound is measured by obtaining a SEM image of the particles of the fluorine-containing aluminium compound using, for example, a field emission scanning electron microscope (FE-SEM) (SU8230, available from Hitachi High-Technologies Corporation), and measuring a ratio (major axis diameter/minor axis diameter) of each of the particles of the fluorine-containing aluminium compound through image analysis. First, the particles of the fluorine-containing aluminium compound are dispersed in tetrahydrofuran, followed by removing the solvent to dry and solidify on a substrate. The resultant sample is observed under the FE-SEM to obtain an image, and a length of the major axis and a length of the minor axis of each of the second particles are measured. An average value of the 200 particles is calculated and is determined as the ratio (major axis diameter/minor axis diameter). An example of the measuring conditions of the FE-SEM is as follows.

[Measuring Conditions of FE-SEM]
Acceleration voltage: 2.0 kV
Working distance (WD): 10.0 mm
Observation magnification: from 50,000 times through 100,000 times The presence of the particles of the fluorine-containing aluminium compound as the inorganic particles can be confirmed by the following method. EDX mapping of the toner is performed by means of an energy dispersive X-ray spectrometer (EDS) (SU8230, available from Hitachi High-Technologies Corporation) under the following conditions, to determine a ratio of the number of atoms of Si, Al or F relative to a total number of atoms Si, Al, and F at the site at which all of Si, Al, and F are detected.

[Measuring Conditions]
Acceleration voltage: 20 kV
Magnification: 40,000 times
Resolution: 256×192
Frame time: the fastest
Frame number: 10,000

<<Silicon Compound>>

The inorganic particles preferably include particles of a silicon compound.

Examples of the silicon compound include silica (silicon dioxide), silicon monoxide, silicic acid, silicon nitride, and silicon carbonate. Among the above-listed examples, silica is preferable.

The number average particle diameter of the particles of the silicon compound is preferably 50 nm or greater but 200 nm or less, and 75 nm or greater but 175 nm or less.

When the number average particle diameter of the particles of the silicon compound is 50 nm or greater, a function as a spacer can be obtained to improve durability, it is difficult for the particles of the silicon compound to be embedded in a toner base particle, and therefore an excellent quality of a resultant toner is maintained over time. When the number average particle diameter of the particles of the silicon compound is 200 nm or less, moreover, functions, such as flowability and chargeability, are excellent.

Note that, the number average particle diameter of the particles of the silicon compound can be measured in the same manner as the measurement of the number average particle diameter of the particles of the aluminium compound described earlier.

A liberation ratio of the particles of the silicon compound is preferably 10% or greater but 30% or less, and more preferably 15% or greater but 25% or less.

When the liberation ratio of the particles of the silicon compound is 10% or greater, the particles of the silicon compound are not embedded in a toner base particle during a mixing step where toner base particles and inorganic particles are mixed, and therefore the toner base particles are not easily spent on carrier particles. In addition, excellent charge stability is obtained. When the liberation ratio of the particles of the silicon compound is 30% or less, the particles of the silicon compound are not easily detached due to stress applied inside a developing device and the toner base particles are not exposed. Therefore, carrier spent does not occur, and photoconductor filming does not occur as an amount of free particles of the silicon compound is small.

For example, the liberation ratio of the particles of the silicon compound can be measured in the same manner as the measurement of the liberation ratio of the inorganic particles described earlier.

The liberation ratio of the particles of the silicon compound can be measured, for example, in the same manner as in the measurement of the liberation ratio of the particles of the inorganic particles. In the case where the inorganic particles include the particles of the silicon compound and another inorganic particles (e.g., the particles of the fluorine-containing aluminium compound), or two or more kinds of the particles of the silicon compound, the liberation ratio of the particles of the silicon compound can be determined by calculating a mass (% by mass) of Si before and after removing another inorganic particles from the intensity on a calibration curve by means of an X-ray fluorescence spectrometer.

<<Other Particles>>

The above-mentioned other particles are not particularly limited and may be appropriately selected depending on the intended purpose, as long as other particles are particles other than the particles of the fluorine-containing aluminium compound and the particles of the silicon compound. The above-mentioned other particles are preferably hydrophobicity-treated inorganic particles.

Examples of shapes of the above-mentioned other particles include spherical shapes, needle shapes, and non-spherical shapes obtained by cohering several spherical particles together.

The above-mentioned other particles are not particularly limited and may be appropriately selected depending on the intended purpose. Examples thereof include fatty acid metal salt (e.g., zinc stearate and aluminium stearate), metal oxide (e.g., titania, alumina, tin oxide, and antimony oxide), and fluoropolymers.

Hydrophobicity-treated titania particles can be obtained, for example, by treating hydrophilic particles with a silane coupling agent, such as methyltrimethoxysilane, methyltriethoxysilane, and octyltrimethoxysilane. Moreover, silicone oil-treated oxide particles where the inorganic particles are optionally treated by adding silicone oil, can be suitably used.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include titanium oxide, barium titanate, magnesium titanate, calcium titanate, strontium titanate, iron oxide, copper oxide, zinc oxide, tin oxide, clay, mica, chromium oxide, cerium oxide, red iron oxide, antimony trioxide, magnesium oxide, zirconium oxide, barium sulfate, barium carbonate, and calcium carbonate.

An amount of the above-mentioned other particles is not particularly limited and may be appropriately selected depending on the intended purpose. The amount thereof is preferably 0.1% by mass or greater but 5% by mass or less, and more preferably 0.3% by mass or greater but 3% by mass or less.

<Toner Base Particles>

Each of the toner base particles includes a binder resin, a colorant, and a release agent, and may further include other components according to the necessity.

<<Binder Resin>>

The binder resin is not particularly limited and may be appropriately selected depending on the intended purpose. As the binder resin, a crystalline polyester resin and an amorphous polyester resin are preferably used.

—Crystalline Polyester Resin—

The crystalline polyester resin (may be referred to as a "crystalline polyester resin C" hereinafter) has thermofusion properties that the crystalline polyester resin sharply turns into viscous at around a fixing onset temperature thereof owing to high crystallinity thereof. Since the crystalline polyester resin C having such properties is used together with the amorphous polyester resin, excellent heat resistant storage stability is obtained up to a melt onset temperature owing to the crystallinity thereof, rapid reduction in viscosity (sharp melt) is caused at a melt onset temperature thereof due to fusion of the crystalline polyester resin C to be compatible to the below-mentioned amorphous polyester resin B, and the rapid reduction in the viscosity makes a resultant toner to be fixed. Therefore, the toner having both excellent heat resistant storage stability and low-temperature fixing ability can be obtained. Moreover, an excellent release width (a difference between the minimum fixing temperature and a hot offset onset temperature) is also obtained.

The crystalline polyester resin C is obtained using polyvalent alcohol, and polyvalent carboxylic acid or a derivative thereof, such as polyvalent carboxylic acid, polyvalent carboxylic acid anhydride, and polyvalent carboxylic acid ester.

In the present disclosure, as described above, the crystalline polyester resin C means a resin obtained using polyvalent alcohol, and polyvalent carboxylic acid or a derivative thereof, such as polyvalent carboxylic acid, polyvalent carboxylic acid anhydride, and polyvalent carboxylic acid ester, and does not include, for example, a modified polyester resin, such as such as a below-described prepolymer and a resin obtained through a cross-linking and/or elongation reaction of the prepolymer.

——Polyvalent Alcohol——

The polyvalent alcohol component is not particularly limited and may be appropriately selected depending on the intended purpose. Examples of the polyvalent alcohol component include diol, and trivalent or higher alcohol.

Examples of the diol include saturated aliphatic diol.

Examples of the saturated aliphatic diol include straight-chain saturated aliphatic diol and branched saturated aliphatic diol. Among the above-listed examples, straight-chain saturated aliphatic diol is preferable, and straight-chain saturated aliphatic diol having 2 or greater but 12 or less carbon atoms is more preferable. When the saturated aliphatic diol is straight-chain saturated aliphatic diol, crystallinity of the crystalline polyester resin C is low and therefore a melting thereof may be low. When the number of carbon atoms of the saturated aliphatic diol is greater than 12, it may be difficult to source a material for practical use. The number of carbon atoms is more preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. The above-listed examples may be used alone or in combination. Among the above-listed examples, ethylene glycol, 1,4-butanediol, 1,6-hexanediol, 1,8-octanediol, 1,10-decanediol, and 1,12-dodecanediol are preferable because of high crystallinity of the crystalline polyester resin C and excellent sharp melt properties thereof.

Examples of the trivalent or higher alcohol include glycerin, trimethylolethane, trimethylolpropane, and pentaerythritol. The above-listed examples may be used alone or in combination.

—Polyvalent Carboxylic Acid—

The polyvalent carboxylic acid is not particularly limited and may be appropriately selected depending on the intended purpose. Examples of the polyvalent carboxylic acid include divalent carboxylic acid and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid (e.g., dibasic acid), such as phthalic acid, isophthalic acid, terephthalic acid, naphthalene-2,6-dicarboxylic acid, malonic acid, and mesaconic acid; and anhydrides and lower alkyl esters (the number of carbon atoms: from 1 through 3) of the above-listed dicarboxylic acids. The above-listed examples may be used alone or in combination.

Examples of the trivalent or higher carboxylic acid include 1,2,4-benzenetricarboxylic acid, 1,2,5-benzenetricarboxylic acid, 1,2,4-naphthalenetricarboxylic acid, anhydrides thereof, and lower alkyl esters (the number of carbon atoms: from 1 through 3) thereof.

The polyvalent carboxylic acid may include, in addition to the saturated aliphatic dicarboxylic acid and the aromatic dicarboxylic acid, dicarboxylic acid having a sulfonic acid group. In addition to the saturated aliphatic dicarboxylic acid and the aromatic dicarboxylic acid, the polyvalent carboxylic acid may further include dicarboxylic acid having a double bond. The above-listed examples may be used alone or in combination.

The crystalline polyester resin C is preferably formed of straight-chain saturated aliphatic dicarboxylic acid having 4 or more but 12 or less carbon atoms and straight-chain saturated aliphatic diol having 2 or more but 12 or less carbon atoms. Specifically, the crystalline polyester resin C preferably includes a constitutional unit derived from saturated aliphatic dicarboxylic acid having 4 or more but 12 or less carbon atoms and a constitutional unit derived from saturated aliphatic diol having 2 or more but 12 or less carbon atoms. The crystalline polyester resin C including the above-mentioned structural units has high crystallinity and excellent sharp melting properties. Therefore, use of such a crystalline polyester resin C is preferable because excellent low-temperature fixing ability is exhibited.

A melting point of the crystalline polyester resin C is not particularly limited and may be appropriately selected depending on the intended purpose. The melting point of the crystalline polyester resin C is preferably 60° C. or higher but 80° C. or lower. When the melting point of the crystalline polyester resin C is 60° C. or higher, the crystalline polyester resin C is not easily melted at a low temperature, and therefore heat resistant storage stability of a resultant toner is excellent. When the melting point of the crystalline polyester resin C is 80° C. or lower, moreover, the crystalline polyester resin C is appropriately melt with heat applied during fixing, and excellent low-temperature fixing ability can be obtained.

A molecular weight of the crystalline polyester resin C is not particularly limited and may be appropriately selected depending on the intended purpose. Since the crystalline polyester resin C having a sharp molecular weight distribution and a low molecular weight give a resultant toner excellent low-temperature fixing ability, and a toner having a large amount of a small molecular weight component has insufficient heat resistant storage stability, a weight average molecular weight (Mw) of an ortho-dichlorobenzene soluble component of the crystalline polyester resin C as measured by GPC is preferably 3,000 or greater but 30,000 or less, a number average molecular weight (Mn) thereof is preferably 1,000 or greater but 10,000 or less, and Mw/Mn is preferably from 1.0 through 10.

Moreover, the weight average molecular weight (Mw) thereof is more preferably 5,000 or greater but 15,000 or less, the number average molecular weight (Mn) thereof is more preferably 2,000 or greater but 10,000 or less, and Mw/Mn is more preferably 1.0 or greater but 5.0 or less.

An acid value of the crystalline polyester resin C is not particularly limited and may be appropriately selected depending on the intended purpose. In order to achieve desired low-temperature fixing ability considering affinity between paper and the resin, the acid value of the crystalline polyester resin C is preferably 5 mgKOH/g or greater, and more preferably 10 mgKOH/g or greater. In order to improve hot offset resistance, on the other hand, the acid value thereof is preferably 45 mgKOH/g or less.

A hydroxyl value of the crystalline polyester resin C is not particularly limited and may be appropriately selected depending on the intended purpose. In order to achieve desired low-temperature fixing ability as well as excellent charging properties, the hydroxyl value of the crystalline polyester resin C is preferably from 0 mgKOH/g through 50 mgKOH/g, and more preferably from 5 mgKOH/g through 50 mgKOH/g.

A molecular structure of the crystalline polyester resin C can be confirmed by solution or solid NMR spectroscopy, X-ray diffraction spectroscopy, GC/MS, LC/MS, or IR spectroscopy. As for a simple method thereof, there is a method where a compound giving an infrared absorption spectrum having absorption based on SCH (out plane bending) of olefin at 965±10 $cm^{-1}$ and 990±10 $cm^{-1}$ is detected as the crystalline polyester resin C.

An amount of the crystalline polyester resin C is not particularly limited and may be appropriately selected depending on the intended purpose. The amount of the crystalline polyester resin C is preferably 3 parts by mass or greater but 20 parts by mass or less, and more preferably 5 parts by mass or greater but 15 parts by mass or less, relative to 100 parts by mass. When the amount thereof is 3 parts by mass or greater, sufficient sharp-melting properties of a resultant toner are obtained owing to the crystalline polyester resin C, and excellent low-temperature fixing ability is obtained. When the amount thereof is 20 parts by mass or less, moreover, excellent heat resistant storage stability is obtained. The amount of the crystalline polyester resin C being within the above-mentioned more preferable range is advantageous because a high image quality and low-temperature fixing ability are both excellent.

<<Amorphous Polyester Resin>>

The amorphous polyester resin is not particularly limited and may be appropriately selected depending on the intended purpose. The amorphous polyester resin preferably includes an amorphous polyester resin A and an amorphous polyester resin B described below.

—Amorphous Polyester Resin A—

The amorphous polyester resin A is not particularly limited and may be appropriately selected depending on the intended purpose. The amorphous polyester resin A preferably has a glass transition temperature (Tg) of −40° C. or higher but 20° C. or lower.

The amorphous polyester resin A is not particularly limited and may be appropriately selected depending on the intended purpose. The amorphous polyester resin A is preferably obtained through a reaction between a non-linear reactive precursor and a curing agent.

Moreover, the amorphous polyester resin A preferably includes a urethane bond, a urea bond, or both because adhesion to a recording medium, such as paper, is improved. Since the amorphous polyester resin A includes either a urethane bond or a urea bond, the urethane bond or the urea bond behaves as a pseudo-crosslinking point to enhance elastic characteristics of the amorphous polyester resin A, and therefore heat resistance storage stability and hot offset resistance of a resultant toner improve.

——Non-Linear Reactive Precursor——

The non-linear reactive precursor is not particularly limited and may be appropriately selected depending on the intended purpose, as long as the non-linear reactive precursor is a polyester resin having a group that can react with the curing agent (may be referred to as a "prepolymer" hereinafter).

Examples of a group of the prepolymer that can react with the curing agent include a group that can react with an active hydrogen group. Examples of the group that can react with an active hydrogen group include an isocyanate group, an epoxy group, carboxylic acid, and an acid chloride group. Among the above-listed examples, an isocyanate group is preferable because a urethane bond or a urea bond can be introduced into the amorphous polyester resin.

The prepolymer is a non-linear polymer. The non-linear means a branched structure imparted by trivalent or higher alcohol, or trivalent or higher carboxylic acid, or both.

The prepolymer is preferably a polyester resin including an isocyanate group.

———Polyester Resin Including Isocyanate Group———

The polyester resin including an isocyanate group is not particularly limited and may be appropriately selected depending on the intended purpose. Examples thereof include a reaction product between a polyester resin including an active hydrogen group and polyisocyanate. The polyester resin including an active hydrogen group is obtained, for example, through polycondensation between diol, dicarboxylic acid, and at least one of trivalent or higher alcohol and trivalent or higher carboxylic acid. The trivalent or higher alcohol and the trivalent or higher carboxylic acid impart a branched structure to the polyester resin including an isocyanate group.

The diol is not particularly limited and may be appropriately selected depending on the intended purpose. Examples of the diol include: aliphatic diol, such as ethylene glycol, 1,2-propyleneglycol, 1,3-propyleneglycol, 1,4-butanediol, 3-methyl-1,5-pentanediol, 1,6-hexanediol, 1,8-octanediol, 1,10-decanediol, and 1,12-dodecanediol; diol including an oxyalkylene group, such as diethylene glycol, triethylene glycol, dipropylene glycol, polyethylene glycol, polypropylene glycol, polytetramethylene glycol; alicyclic diol, such as 1,4-cyclohexanedimethanol, and hydrogenated bisphenol A; products obtained adding alkylene oxide (e.g., ethylene oxide, propylene oxide, and butylene oxide) to alicyclic diol; bisphenols, such as bisphenol A, bisphenol F, and bisphenol S; and alkylene oxide adducts of bisphenols, such as products obtained by adding alkylene oxide (e.g., ethylene oxide, propylene oxide, and butylene oxide) to bisphenols. Among the above-listed examples, aliphatic diol having 4 or more but 12 or less carbon atoms is preferable.

The above-listed diols may be used alone or in combination.

The dicarboxylic acid is not particularly limited and may be appropriately selected depending on the intended purpose. Examples of the dicarboxylic acid include aliphatic dicarboxylic acid, and aromatic dicarboxylic acid. Moreover, anhydrides thereof, lower alkyl esters (the number of carbon atoms: from 1 through 3) thereof, or halogenated product thereof may be used.

The aliphatic dicarboxylic acid is not particularly limited and may be appropriately selected depending on the intended purpose. Examples thereof include succinic acid, adipic acid, sebacic acid, dodecanedioic acid, maleic acid, and fumaric acid.

The aromatic dicarboxylic acid is not particularly limited and may be appropriately selected depending on the intended purpose, and is preferably aromatic dicarboxylic acid having from 8 through 20 carbon atoms. The aromatic dicarboxylic acid having from 8 through 20 carbon atoms is not particularly limited and may be appropriately selected depending on the intended purpose. Examples thereof include phthalic acid, isophthalic acid, terephthalic acid, and naphthalene dicarboxylic acid. Among the above-listed examples, aliphatic dicarboxylic acid having 4 or more but 12 or less carbon atoms is preferable. The above-listed dicarboxylic acids may be used alone or in combination.

The trivalent or higher alcohol is not particularly limited and may be appropriately selected depending on the intended purpose. Examples thereof include trivalent or higher aliphatic alcohol, trivalent or higher polyphenols, and alkylene oxide adducts of trivalent or higher polyphenols.

Examples of the trivalent or higher aliphatic alcohol include glycerin, trimethylolethane, trimethylolpropane, pentaerythritol, and sorbitol.

Examples of the trivalent or higher polyphenols include trisphenol PA, phenol novolac, and cresol novolac.

Examples of the alkylene oxide adducts of polyphenols include adducts of trivalent or higher polyphenols with alkylene oxide (e.g., ethylene oxide, propylene oxide, and butylene oxide).

The amorphous polyester resin A preferably includes trivalent or higher aliphatic alcohol as a constitutional component.

Since the amorphous polyester resin A includes trivalent or higher aliphatic alcohol as a constitutional component, a molecular framework has a branched structure and a molecular chain has a three-dimensional network structure. Therefore, the amorphous polyester resin A has elastic characteristics that the amorphous polyester A deforms at a low temperature but does not flow out. A resultant toner therefore can obtain heat resistant storage stability and hot offset resistance.

For the amorphous polyester resin A, trivalent or higher carboxylic acid or epoxy may be used as a crosslinking component. In case of carboxylic acid, it is often an aromatic compound, and density of an ester bond at a cross-linking site becomes high. Therefore, a fixing image obtained by heating and fixing a resultant toner may have sufficient gloss.

In the case where a crosslinking agent, such as epoxy, is used, a cross-linking reaction is performed after polymerization of polyester, and therefore it is difficult to control a distance between crosslinking points and target elasticity cannot be obtained, or a fixing image is uneven to give low gloss or image density because the crosslinking agent tends to react with oligomer at the time of generating polyester to generate sites having high crosslinking density.

The trivalent or higher carboxylic acid is not particularly limited and may be appropriately selected depending on the intended purpose. Examples of the trivalent or higher carboxylic acid include trivalent or higher aromatic carboxylic acid. Moreover, anhydrides, lower alkyl esters (the number of carbon atoms: from 1 through 3), or halogenated products of the trivalent or higher aromatic carboxylic acid may be used.

The trivalent or higher aromatic carboxylic acid is preferably trivalent or higher aromatic carboxylic acid having from 9 through 20 carbon atoms. Examples of the trivalent or higher aromatic carboxylic acid having from 9 through 20 carbon atoms include trimellitic acid, and pyromellitic acid.

The polyisocyanate is not particularly limited and may be appropriately selected depending on the intended purpose. Examples thereof include diisocyanate and trivalent or higher isocyanate.

Examples of the diisocyanate include aliphatic diisocyanate, alicyclic diisocyanate, aromatic diisocyanate, aromatic aliphatic diisocyanate, isocyanurate, and products obtained by blocking the above-listed polyisocyanates with a phenol derivative, oxime, or caprolactam.

The aliphatic diisocyanate is not particularly limited and may be appropriately selected depending on the intended purpose. Examples of the aliphatic diisocyanate include tetramethylene diixocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanatodiphenyl methane, 1,5-naphthylenediisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The aromatic aliphatic diisocyanate is not particularly limited and may be appropriately selected depending on the intended purpose. Examples of the aromatic aliphatic diisocyanate include $\alpha,\alpha,\alpha',\alpha'$-tetramethylxylenediisocyanate.

The isocyanurate is not particularly limited and may be appropriately selected depending on the intended purpose. Examples thereof include tris(isocyanatalkyl)isocyanurate, and tris(isocyanatocycloalkyl)isocyanurate.

The above-listed polyisocyanates may be used alone or in combination.

—Curing Agent—

The curing agent is not particularly limited and may be appropriately selected depending on the intended purpose, as long as the curing agent reacts with the non-linear reactive precursor to generate the amorphous polyester resin A. Examples thereof include an active hydrogen group-containing compound.

——Active Hydrogen Group-Containing Compound——

An active hydrogen group in the active hydrogen group-containing compound is not particularly limited and may be appropriately selected depending on the intended purpose. Examples of the active hydrogen group include a hydroxyl group (e.g., an alcoholic hydroxyl group and a phenolic hydroxyl group), an amino group, a carboxyl group, and a mercapto group. The above-listed examples may be used alone or in combination.

The active hydrogen group-containing compound is not particularly limited and may be appropriately selected depending on the intended purpose. The active hydrogen group-containing compound is preferably amines because a urea bond can be formed.

The amines are not particularly limited and may be appropriately selected depending on the intended purpose. Examples of the amines include diamine, trivalent or higher amine, amino alcohol, aminomercaptan, amino acid, and products obtained by blocking an amino group of the above-listed amines. The above-listed examples may be used alone or in combination.

Among the above-listed examples, diamine, and a mixture of diamine and a small amount of trivalent or higher amine are preferable.

The diamine is not particularly limited and may be appropriately selected depending on the intended purpose. Examples of the diamine include aromatic diamine, alicyclic diamine, and aliphatic diamine. The aromatic diamine is not particularly limited and may be appropriately selected depending on the intended purpose. Examples of the aromatic diamine include phenylene diamine, diethyl toluene diamine, and 4,4'-diaminodiphenylmethane. The alicyclic diamine is not particularly limited and may be appropriately selected depending on the intended purpose. Examples of the alicyclic diamine include 4,4'-diamino-3,3'-dimethyldicyclohexylmethane, diaminocyclohexane, and isophoronediamine. The aliphatic diamine is not particularly limited and may be appropriately selected depending on the intended purpose. Examples of the aliphatic diamine include ethylenediamine, tetramethylenediamine, and hexamethylenediamine.

The trivalent or higher amine is not particularly limited and may be appropriately selected depending on the intended purpose. Examples of the trivalent or higher amine include diethylenetriamine, and triethylenetetramine.

Examples of the amino alcohol is not particularly limited and may be appropriately selected depending on the intended purpose. Examples of the amino alcohol include ethanolamine, and hydroxyethylaniline.

The aminomercaptan is not particularly limited and may be appropriately selected depending on the intended purpose. Examples of the aminomercaptan include aminoethylmercaptan, and aminopropylmercaptan.

The amino acid is not particularly limited and may be appropriately selected depending on the intended purpose. Examples of the amino acid include amino propionic acid, and amino caproic acid.

The products obtained by blocking the amino group are not particularly limited and may be appropriately selected depending on the intended purpose. Examples of the products obtained by blocking the amino group include ketimine compounds and oxazolidine compounds each obtained by blocking the amino group with ketones, such as acetone, methyl ethyl ketone, and methyl isobutyl ketone.

In order to make a glass transition temperature (Tg) of the amorphous polyester resin A low to impart characteristics that the amorphous polyester resin deforms at a low temperature, the amorphous polyester resin A includes a diol component as a constitutional component, and the diol component preferably includes aliphatic diol having 4 or more but 12 or less carbon atoms in the amount of 50% by mass or greater.

In order to make a glass transition temperature (Tg) of the amorphous polyester resin A low to impart characteristics that the amorphous polyester resin deforms at a low temperature, moreover, the amorphous polyester resin A preferably includes 50% by mass or greater of aliphatic diol having 4 or more but 12 or less carbon atoms relative to a total alcohol component.

In order to make a glass transition temperature (Tg) of the amorphous polyester resin A low to impart characteristics that the amorphous polyester resin deforms at a low temperature, the amorphous polyester resin A includes a dicarboxylic acid component as a constitutional component, and the dicarboxylic acid component preferably includes aliphatic dicarboxylic acid having 4 or more but 12 or less carbon atoms in the amount of 50% by mass or greater.

The weight average molecular weight of the amorphous polyester resin A is not particularly limited and may be appropriately selected depending on the intended purpose. The weight average molecular weight thereof as measured by gel permeation chromatography (GPC) is preferably 20,000 or greater but 1,000,000 or less, more preferably 50,000 or greater but 300,000 or less, and particularly preferably 100,000 or greater but 200,000 or less. When the weight average molecular weight thereof is less than 20,000, a resultant toner tends to flow at a low temperature, heat resistant storage stability of the toner may be low. Moreover, viscosity of the toner is low at the time of melting, and therefore hot offset may occur.

A molecular structure of the amorphous polyester resin A can be confirmed by solution or solid NMR spectroscopy, X-ray diffraction spectroscopy, GC/MS, LC/MS, or IR spectroscopy. As for a simple method thereof, there is a method where a compound giving an infrared absorption spectrum having no absorption based on $\delta_{CH}$ (out plane bending) of olefin at 965±10 $cm^{-1}$ and 990±10 $cm^{-1}$ is detected as the amorphous polyester resin.

An amount of the amorphous polyester resin A is not particularly limited and may be appropriately selected depending on the intended purpose. The amount of the amorphous polyester resin A is preferably 5 parts by mass or greater but 25 parts by mass or less, and more preferably 10 parts by mass or greater but 20 parts by mass or less, relative to 100 parts by mass of the toner. When the amount thereof is 5 parts by mass or greater, excellent low-temperature fixing ability and hot offset resistance can be obtained. When the amount thereof is 25 parts by mass or less, moreover, excellent heat resistant storage stability is obtained, and therefore glossiness of an image obtained after fixing is excellent. The amount of the amorphous polyester resin A being within the above-mentioned more preferable range is advantageous because low-temperature fixing ability, hot offset resistance, and heat resistant storage stability are all excellent.

<<<Amorphous Polyester Resin B>>>

The amorphous polyester resin B preferably has a glass transition temperature (Tg) of 40° C. or higher but 80° C. or lower.

The amorphous polyester resin B is preferably a linear polyester resin.

The amorphous polyester resin B is preferably an unmodified polyester resin. The unmodified polyester resin is a polyester resin obtained from polyvalent alcohol and polyvalent carboxylic acid or a derivative thereof, such as polyvalent carboxylic acid, polyvalent carboxylic acid anhydride, and polyvalent carboxylic acid ester. The unmodified polyester resin is a polyester resin that is not modified with an isocyanate compound etc.

The amorphous polyester resin B preferably does not include a urethane bond and a urea bond.

The amorphous polyester resin B preferably includes a dicarboxylic acid component as a constitutional component, and the dicarboxylic acid component preferably includes terephthalic acid in the amount of 50 mol % or greater. Such the amorphous polyester resin B is advantageous in view of heat resistant storage stability.

Examples of the polyvalent alcohol include diol.

Examples of the diol include: alkylene (the number of carbon atoms: from 2 through 3) oxide adduct (the average number of moles added: from 1 through 10) of bisphenol A, such as polyoxypropylene(2.2)-2,2-bis(4-hydroxyphenyl) propane, and polyoxyethylene(2.2)-2,2-bis(4-hydroxyphenyl)propane; ethylene glycol; propylene glycol; hydrogenated bisphenol A; and alkylene (the number of carbon atoms: from 2 through 3) oxide adduct (the average number of moles added: from 1 through 10) of hydrogenated bisphenol A. The above-listed examples may be used alone or in combination.

Examples of the polyvalent carboxylic acid include dicarboxylic acid.

Examples of the dicarboxylic acid include adipic acid, phthalic acid, isophthalic acid, terephthalic acid, fumaric acid, maleic acid, and succinic acid substituted with an alkyl group having from 1 through 20 carbon atoms or an alkenyl group having from 2 through 20 carbon atoms (e.g., dodecenyl succinic acid and octyl succinic acid). The above-listed examples may be used alone or in combination.

For the purpose of adjusting an acid value and a hydroxyl value, moreover, the amorphous polyester resin B may include trivalent or higher carboxylic acid, trivalent or higher alcohol, or both at terminals of the molecular chain of the amorphous polyester resin B.

Examples of the trivalent or higher carboxylic acid include trimellitic acid, pyromellitic acid, or acid anhydrides thereof.

Examples of the trivalent or higher alcohol include glycerin, pentaerythritol, and trimethylolpropane.

A molecular weight of the amorphous polyester resin B is not particularly limited and may be appropriately selected depending on the intended purpose. When the molecular weight thereof is too small, heat resistant storage stability of a resultant toner may be poor, and the toner may have poor durability against stress applied inside a developing device, such as stirring. When the molecular weight thereof is too large, viscoelasticity of a resultant toner becomes high at the time of melting the toner, and low-temperature fixing ability may be poor. Therefore, the weight average molecular weight (Mw) of the amorphous polyester resin B as measured by gel permeation chromatography (GPC) is preferably 3,000 or greater but 10,000 or less.

Moreover, the number average molecular weight (Mn) thereof is preferably 1,000 or greater but 4,000 or less. Moreover, Mw/Mn is preferably 1.0 or greater but 4.0 or less.

The weight average molecular weight (Mw) thereof is more preferably 4,000 or greater but 7,000 or less. The number average molecular weight (Mn) thereof is more preferably 1,500 or greater but 3,000 or less. The Mw/Mn is more preferably 1.0 or greater but 3.5 or less.

An acid value of the amorphous polyester resin B is not particularly limited and may be appropriately selected depending on the intended purpose. The acid value thereof is preferably 1 mgKOH/g or greater but 50 mgKOH/g or less, and more preferably 5 mgKOH/g or greater but 30 mgKOH/g or less. When the acid value thereof is 1 mgKOH/g or greater, a resultant toner tends to be negatively charged, affinity between paper and the toner improves at the time of fixing to the paper, and therefore low-temperature fixing ability can be improved. When the acid value thereof is 50 mgKOH/g or less, excellent charge stability is obtained, and particularly charge stability against fluctuations of the environment can be improved.

A hydroxyl value of the amorphous polyester resin B is not particularly limited and may be appropriately selected depending on the intended purpose. The hydroxyl value thereof is preferably 5 mgKOH/g or greater.

A glass transition temperature (Tg) of the amorphous polyester resin B is preferably 40° C. or higher but 80° C. or lower, and more preferably 50° C. or higher but 70° C. or lower. When the glass transition temperature thereof is 40° C. or higher, a resultant toner has sufficient heat resistant storage stability and durability against stress applied inside a developing device, such as stirring, and moreover excellent filming resistance can be obtained. When the glass transition temperature thereof is 80° C. or lower, a resultant toner sufficiently deforms by heat and pressure applied at the time of fixing, and therefore excellent low-temperature fixing ability is obtained.

A molecular structure of the amorphous polyester resin B can be confirmed by solution or solid NMR spectroscopy, X-ray diffraction spectroscopy, GC/MS, LC/MS, or IR spectroscopy. As for a simple method thereof, there is a method where a compound giving an infrared absorption spectrum having no absorption based on SCH (out plane bending) of olefin at 965 $cm^{-1}$±10 $cm^{-1}$ and 990 $cm^{-1}$±10 $cm^{-1}$ is detected as the amorphous polyester resin.

An amount of the amorphous polyester resin B is not particularly limited and may be appropriately selected depending on the intended purpose. The amount thereof is preferably 50 parts by mass or greater but 90 parts by mass or less, and more preferably 60 parts by mass or greater but 80 parts by mass or less, relative to 100 parts by mass of the toner. When the amount thereof is 50 parts by mass or greater, dispersibility of a pigment and a release agent inside a resultant toner is excellent, and therefore an image of high image quality can be obtained. When the amount thereof is 90 parts by mass or less, moreover, excellent low-temperature fixing ability is obtained because an amount of the crystalline polyester resin C and an amount of the amorphous polyester resin A are appropriate. The amount of the amorphous polyester resin B being within the more preferable range is advantageous because high image quality and low-temperature fixing ability are both excellent.

In order to improve low-temperature fixing ability, the amorphous polyester resin A is preferably used in combination with the crystalline polyester resin C. In order to obtain both low-temperature fixing ability and storage stability at high temperatures and high humidity, the amorphous polyester resin A preferably has an extremely low glass transition temperature. Since the glass transition temperature thereof is extremely low, the amorphous polyester resin A has characteristics that the amorphous polyester resin A deforms at a low temperature, deforms by heat and pressure applied at the time of fixing, and is easily adhered to a recording medium, such as paper, at a temperature lower than a fixing temperature used in the art. Since a reactive precursor is non-linear in one embodiment of the amorphous polyester resin A, the amorphous polyester resin A has a branched structure in a molecular framework thereof and a molecular chain thereof forms a three-dimensional network structure. Therefore, the amorphous polyester resin A has elastic characteristics that the amorphous polyester resin A deforms at a low temperature but does not flow. Accordingly, a resultant toner can obtain both heat resistant storage stability and hot offset resistance.

In the case where the amorphous polyester resin A includes a urethane bond or urea bond having high aggregation energy, adhesion of a resultant toner to a recording medium, such as paper, improves. Since the urethane bond or urea bond behaves as a pseudo-crosslinking point, moreover, elastic characteristics of the amorphous polyester resin A are enhanced. As a result, a resultant toner has more excellent heat resistant storage stability and hot offset resistance. Specifically, the toner of the present disclosure has extremely excellent low-temperature fixing ability when the amorphous polyester resin A and the crystalline polyester resin C, and optionally other amorphous polyester resins B are used in combination. Since the amorphous polyester resin A having a glass transition temperature in an extremely low temperature range is used, moreover, heat resistant storage stability and hot offset resistance can be maintained even when a glass transition temperature of a toner is set lower than that of a toner in the art, and the toner has excellent low-temperature fixing ability because the glass transition temperature of the toner is set low.

<<Other Components>>

Examples of the above-mentioned other components include a release agent, a colorant, a charge controlling agent, a flowability improving agent, a cleaning improving agent, and a magnetic material.

—Release Agent—

The release agent is not particularly limited and may be appropriately selected depending on the intended purpose.

Examples of the release agent (e.g., wax) include natural wax, such as vegetable wax (e.g., carnauba wax, cotton wax, and Japanese wax), animal wax (e.g., bees wax and lanolin wax), mineral wax (e.g., ozocerite and ceresin), and petroleum wax (e.g., paraffin wax, microcrystalline wax, and petrolatum wax).

Moreover, the examples include, in addition to the above-listed natural wax, synthetic hydrocarbon wax (e.g., Fischer-Tropsch wax, polyethylene wax, and polypropylene wax), and synthetic wax (e.g., ester, ketone, and ether).

Furthermore, usable may be fatty acid amide-based compounds (e.g., 12-hydroxystearic acid amide, stearic acid amide, phthalimide anhydride, and chlorinated hydrocarbon), a low molecular-weight crystalline polyester resin, such as a homopolymer of polyacrylate (e.g., poly-n-stearylmethacrylate, and poly-n-laurylmethacrylate) or copolymer thereof (e.g., a n-stearylacrylate-ethylmethacrylate copolymer), and a crystalline polymer having a long alkyl chain at a side chain thereof.

Among the above-listed examples, hydrocarbon-based wax, such as paraffin wax, microcrystalline wax, Fischer-Tropsch wax, polyethylene wax, and polypropylene wax are preferable.

The melting point of the release agent is not particularly limited and may be appropriately selected depending on the intended purpose. The melting point thereof is preferably 60° C. or higher but 80° C. or lower. When the melting point is 60° C. or higher but 80° C. or lower, excellent heat resistant storage stability, and fixing offset resistance can be obtained.

An amount of the release agent is not particularly limited and may be appropriately selected depending on the intended purpose. The amount of the release agent is preferably 2 parts by mass or greater but 10 parts by mass or less, and more preferably 3 parts by mass or greater but 8 parts by mass or less, relative to 100 parts by mass of the toner. When the amount thereof is 2 parts by mass or greater, excellent hot offset resistance at the time of fixing and excellent low-temperature fixing ability can be obtained. When the amount thereof is 10 parts by mass or less, moreover, heat resistance storage stability is excellent, and an image of high image quality can be obtained with a resultant toner. When the amount thereof is within the more preferable range, it is advantageous because high image quality is obtained and fixing stability can be improved.

—Colorant—

The colorant is not particularly limited and may be appropriately selected depending on the intended purpose. Examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, para-red, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. The above-listed examples may be used alone or in combination.

An amount of the colorant is not particularly limited and may be appropriately selected depending on the intended purpose. The amount of the colorant is preferably 1 part by mass or greater but 15 parts by mass or less, and more preferably 3 parts by mass or greater but 10 parts by mass or less, relative to 100 parts by mass of the toner.

The colorant may be also used as a master batch in which the colorant forms a composite with a resin. Examples of a resin used for production of the master batch or kneaded together with the master batch include, in addition to the amorphous polyester resin: polymers of styrene or substituted styrene, such as polystyrene, poly(p-chlorostyrene), and polyvinyl toluene; styrene-based copolymers, such as styrene-p-chlorostyrene copolymer, styrene-propylene copolymer, styrene-vinyltoluene copolymer, styrene-vinylnaphthalene copolymer, styrene-methacrylate copolymer, styrene-ethylacrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-malleic acid ester copolymer; polymethyl methacrylate; polybutyl methacrylate; polyvinyl chloride; polyvinyl acetate; polyethylene; polypropylene; polyester; an epoxy resin; an epoxypolyol resin; polyurethane; polyamide; polyvinyl butyral; polyacrylic resin; rosin; modified rosin; a terpene resin; aliphatic or alicyclic hydrocarbon resin; an aromatic petroleum resin; chlorinated paraffin; and paraffin wax. The above-listed examples may be used alone or in combination.

The master batch can be obtained by applying high shear force to a resin for a master batch and a colorant to mix and kneading the mixture. In order to enhance interaction between the colorant and the resin, an organic solvent can be used. Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent. As for the mixing and kneading, a high-shearing disperser (e.g., a three-roll mill) is preferably used.

—Charging Controlling Agent—

The charging controlling agent is not particularly limited and may be appropriately selected depending on the intended purpose. Examples of the charge controlling agent include a nigrosine-based dye, a triphenylmethane-based dye, a chrome-containing metal complex dye, a molybdic acid chelate pigment, a rhodamine-based dye, an alkoxy-based amine, a quaternary ammonium salt (including fluorine-modified quaternary ammonium, alkylamide, phosphorus or a compound thereof, tungsten or a compound thereof, a fluorosurfactant, a metal salt of salicylic acid, and a metal salt of a salicylic acid derivative.

Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901, and boron complex LR-147 (manufactured by Japan Carlit Co., Ltd.); copper phthalocyanine; perylene; quinacridone; azo pigments; and other polymeric compounds having, as a functional group, a sulfonic acid group, carboxyl group, and quaternary ammonium salt.

An amount of the charge controlling agent is not particularly limited and may be appropriately selected depending on the intended purpose. The amount thereof is preferably 0.1 parts by mass or greater but 10 parts by mass or less, and more preferably 0.2 parts by mass or greater but 5 parts by mass or less, relative to 100 parts by mass of the toner. When the amount thereof is 10 parts by mass or less, chargeability of a resultant toner is appropriate, an effect of a main charge controlling agent is excellent, an electrostatic suction force with a developing roller is appropriate, flowability of a resulting developer is excellent, and high image density can be obtained. The charge controlling agent may be melt-kneaded with a master batch or resin, followed by dissolving and dispersing in an organic solvent. Alternatively, the charge controlling agent may be directly added when other materials are dissolved and dispersed, or may be deposited and fixed on surfaces of toner base particles, after producing the toner base particles.

—Flowability Improving Agent—

The flowability improving agent is not particularly limited and may be appropriately selected depending on the intended purpose, as long as the flowability improving agent is an agent used to perform a surface treatment to increase hydrophobicity to prevent degradation of flowability and charging properties even in high humidity environment. Examples of the flowability improving agent include a silane coupling agent, a silylation agent, a silane-coupling agent containing a fluoroalkyl group, an organic titanate-based coupling agent, an aluminum-based coupling agent, silicone oil, and modified-silicone oil. The silica and the titanium oxide are particularly preferably subjected to a surface treatment with any of the above-listed flowability improving agents to be used as hydrophobic silica and hydrophobic titanium oxide.

—Cleaning Improving Agent—

The cleaning improving agent is not particularly limited and may be appropriately selected depending on the intended purpose, as long as the cleaning improving agent is an agent added to the toner in order to remove a developer remained on a photoconductor or a primary transfer member after transferring. Examples of the cleaning improving agent include: fatty acid (e.g., stearic acid) metal salts, such as zinc stearate, and calcium stearate; and polymer particles produced by soap-free emulsification polymerization, such as polymethyl methacrylate particles, and polystyrene particles. The polymer particles are preferably polymer particles having a relatively narrow particle size distribution. The volume average particle diameter thereof is more preferably 0.01 μm or greater but 1 μm or less.

—Magnetic Material—

The magnetic material is not particularly limited and may be appropriately selected depending on the intended purpose. Examples of the magnetic material include iron powder, magnetite, and ferrite. Among the above-listed examples, white magnetic materials are preferable in view of color tone.

(Production Method of Toner)

A production method of the toner is not particularly limited and may be appropriately selected depending on the intended purpose. The production method thereof preferably includes a mixing step including mixing toner base particles and inorganic particles, and more preferably further includes a toner base particle-production step. The production method may further include other steps according to the necessity.

<Toner Base Particle-Production Step>

The toner base particles are preferably granulated by dispersing, in an aqueous medium, an oil phase including the amorphous polyester resin A, the amorphous polyester resin B, and the crystalline polyester resin C, and optionally including the release agent, the colorant, etc.

Moreover, the toner base particles are preferably granulated by dispersing, in an aqueous medium, an oil phase including the non-linear reactive precursor, the amorphous polyester resin B, and the crystalline polyester resin C, and optionally including the curing agent, the release agent, the colorant, etc.

An example of such a production method of the toner base particles include a dissolution suspension method known in the art. As an example of the production method of the toner base particles, described below is a method where toner base particles are formed with extending an amorphous polyester resin A through an elongation reaction and/or cross-linking reaction between the prepolymer and the curing agent. In this method, preparation of an aqueous medium, preparation of an oil phase including toner materials, emulsification or dispersion or the toner materials, and removal of an organic solvent are performed. Thereafter, the obtained toner base particles and the external additives are mixed to obtain the toner.

<<Preparation of Aqueous Medium (Aqueous Phase)>>

For example, preparation of the aqueous medium can be performed by dispersing resin particles in an aqueous medium. An amount of the resin particles added to the aqueous medium is not particularly limited and may be appropriately selected depending on the intended purpose. The amount of the resin particles is preferably 0.5 parts by mass or greater but 10 parts by mass of less relative to 100 parts by mass of the aqueous medium.

The aqueous medium is not particularly limited and may be appropriately selected depending on the intended purpose. Examples of the aqueous medium include a water, a solvent miscible with water, and a mixture thereof. The above-listed examples may be used alone or in combination. Among the above-listed examples, water is preferable.

The solvent miscible with water is not particularly limited and may be appropriately selected depending on the intended purpose. Examples thereof include alcohol, dimethylformamide, tetrahydrofuran, cellosolves, and lower ketones. The alcohol is not particularly limited and may be appropriately selected depending on the intended purpose. Examples of the alcohol include methanol, isopropanol, and ethylene glycol. The lower ketones are not particularly limited and may be appropriately selected depending on the intended purpose. Examples of the lower ketones include acetone, and methyl ethyl ketone.

<<Preparation of Oil Phase>>

Preparation of the oil phase including toner materials can be performed by dissolving or dispersing, in an organic solvent, toner materials including at least the non-linear reactive precursor, the amorphous polyester resin B, and the crystalline polyester resin C, and optionally further including the curing agent, the release agent, and the colorant.

The organic solvent is not particularly limited and may be appropriately selected depending on the intended purpose. The organic solvent is preferably an organic solvent having a boiling point of lower than 150° C. because such an organic solvent is easily removed.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. The above-listed examples may be used alone or in combination.

Among the above-listed examples, ethyl acetate, toluene, xylene, benzene, methylene chloride, 1,2-dichloroethane, chloroform, and carbon tetrachloride are preferable, and ethyl acetate is more preferable.

<<Emulsification or Dispersion>>

Emulsification or dispersion of the toner materials can be performed by dispersing the oil phase including the toner materials in the aqueous medium. When the toner materials are emulsified or dispersed, the curing agent and the non-linear reactive precursor are allowed to react through an elongation reaction and/or cross-linking reaction to thereby generate the amorphous polyester resin A.

For example, the amorphous polyester resin A can be generated by any of the following methods (1) to (3).

(1) A method where an oil phase including the non-linear reactive precursor and the curing agent is emulsified or dispersed in an aqueous medium, and the curing agent and the non-linear reactive precursor are allowed to react through an elongation reaction and/or a cross-linking reaction in the aqueous medium to thereby generate the amorphous polyester resin A.

(2) A method where an oil phase including the non-linear reactive precursor is emulsified or dispersed in an aqueous medium to which the curing agent has been added in advance, and the curing agent and the non-linear reactive precursor are allowed to react through an elongation reaction and/or a cross-linking reaction in the aqueous medium to thereby generate the amorphous polyester resin A.

(3) A method where, after emulsifying or dispersing an oil phase including the non-linear reactive precursor in an aqueous medium, the curing agent is added to the aqueous medium, and the curing agent and the non-linear reactive precursors are allowed to react through an elongation reaction and/or a cross-linking reaction at interfaces of particles in the aqueous medium, to thereby generate the amorphous polyester resin A.

In the case where the curing agent and the non-linear reactive precursors are allowed to react through an elongation reaction and/or a cross-linking reaction at interfaces of particles, the amorphous polyester resin A is preferentially formed at surfaces of toner particles to be formed to give a concentration gradient of the amorphous polyester resin A inside the toner particles.

Reaction conditions (e.g., reaction duration and a reaction temperature) of the amorphous polyester resin A are not particularly limited and may be appropriately selected depending on a combination of the curing agent and the non-linear reactive precursor.

The reaction duration is not particularly limited and may be appropriately selected depending on the intended purpose. The reaction duration is preferably from 10 minutes through 40 hours, and more preferably from 2 hours through 24 hours.

The reaction temperature is not particularly limited and may be appropriately selected depending on the intended purpose. The reaction temperature is preferably 0° C. or higher but 150° C. or lower, and more preferably 40° C. or higher but 98° C. or lower.

A method for stably forming a dispersion liquid including the non-linear reactive precursor in the aqueous medium is not particularly limited and may be appropriately selected depending on the intended purpose. Examples thereof include a method where an oil phase, which has been prepared by dissolving or dispersing toner materials in a solvent, is added to an aqueous medium, and a resultant is dispersed by shear force.

A disperser used for the dispersing is not particularly limited and may be appropriately selected depending on the intended purpose. Examples thereof include a low-speed shearing disperser, a high-speed shearing disperser, a friction disperser, a high-pressure jet disperser, and an ultrasonic disperser.

Among the above-listed examples, a high-speed shearing disperser is preferable because particle diameters of dispersed elements (oil droplets) can be controlled to the range of 2 μm or greater but 20 μm or less.

In the case where the high-speed shearing disperser is used, the conditions thereof, such as rotational speed, dispersion duration, and a dispersion temperature, are appropriately selected depending on the intended purpose.

The rotational speed is not particularly limited and may be appropriately selected depending on the intended purpose. The rotational speed is preferably 1,000 rpm or greater but 30,000 rpm or less, and more preferably 5,000 rpm or greater but 20,000 rpm or less.

The dispersion duration is not particularly limited and may be appropriately selected depending on the intended purpose. In case of a batch system, the dispersing duration is preferably 0.1 minutes or longer but 5 minutes or shorter.

The dispersion temperature is not particularly limited and may be appropriately selected depending on the intended purpose. The dispersing temperature is preferably 0° C. or higher but 150° C. or lower, and more preferably 40° C. or higher but 98° C. or lower under the pressure. Note that, generally, dispersing is more easily performed when the dispersing temperature is a high temperature.

When the toner materials are emulsified or dispersed, an amount of the aqueous medium for use is not particularly limited and may be appropriately selected depending on the intended purpose. The amount thereof is preferably 50 parts by mass or greater but 2,000 parts by mass or less, and more preferably 100 parts by mass or greater but 1,000 parts by mass or less, relative to 100 parts by mass of the toner.

When the amount of the aqueous medium for use is less than 50 parts by mass, the dispersed state of the toner materials is not desirable, and toner base particles having predetermined particle diameters may not be obtained. When the amount thereof is greater than 2,000 parts by mass, a production cost may become high.

When the oil phase including the toner materials is emulsified or dispersed, a dispersing agent is preferably used for the purpose of stabilizing dispersed elements, such as oil droplets, to obtain desired shapes and make a particle size distribution thereof sharp.

The dispersing agent is not particularly limited and may be appropriately selected depending on the intended purpose. Examples thereof include a surfactant, a poorly water-soluble inorganic compound dispersing agent, and a polymer-based protective colloid. The above-listed examples may be used alone or in combination. Among the above-listed examples, a surfactant is preferable.

The surfactant is not particularly limited and may be appropriately selected depending on the intended purpose. For example, an anionic surfactant, a cationic surfactant, a nonionic surfactant, or an amphoteric surfactant can be used as the surfactant.

The anionic surfactant is not particularly limited and may be appropriately selected depending on the intended purpose. Examples thereof include alkyl benzene sulfonic acid salt, α-olefin sulfonic acid salt, and phosphoric acid ester. Among the above-listed examples, a surfactant including a fluoroalkyl group is preferable.

A catalyst may be used for an elongation reaction and/or a cross-linking reaction performed when the amorphous polyester resin A is generated.

The catalyst is not particularly limited and may be appropriately selected depending on the intended purpose. Examples thereof include dibutyl tin laurate, and dioctyl tin laurate.

<<Removal of Organic Solvent>>

A method for removing the organic solvent from the dispersion liquid, such as the emulsified slurry, is not particularly limited and may be appropriately selected depending on the intended purpose. Examples of the method include: a method where an entire reaction system is gradually heated to evaporate an organic solvent inside oil droplets; and a method where a dispersion liquid is sprayed in a dry atmosphere to remove an organic solvent inside oil droplets.

Once the organic solvent is removed, toner base particles are formed. Washing, drying, etc. can be performed on the toner base particles, and classification etc. may be further performed. The classification may be performed by removing a fine particle component by cyclon in a liquid, a decanter, or centrifugation. Alternatively, an operation of the classification may be performed after drying.

<Mixing Step>

The obtained toner base particles are mixed with the inorganic particles. At the time of mixing with the inorganic particles, a typical powder mixer may be used, but it is preferable that an internal temperature of the mixer be adjusted by fitting a jacket etc. In order to change a history of a load applied to the inorganic particles, the inorganic particles may be added in the middle of the mixing process or gradually added. In this case, the rotational speed, rolling speed, duration, temperature, etc., of the mixer may be changed. Moreover, a strong load may be applied first, and then a relatively weak load may be applied, or vice versa. Examples of the mixing device for use include a V-shaped mixer, Rocking Mixer, Loedige Mixer, Nauta Mixer, and Henschel Mixer. Subsequently, the resultant is passed through a sieve with a 250-mesh or finer to remove coarse particles and aggregated particles, to thereby obtain toner particles.

(Toner Stored Unit)

A toner stored unit of the present disclosure is a unit that has a function of storing a toner and stores therein the toner. Examples of embodiments of the toner stored unit include a toner stored container, a developing device, and a process cartridge.

The toner stored container is a container in which a toner is stored.

The developing device is a device including a unit configured to store a toner and develop.

The process cartridge is a process cartridge which includes at least an electrostatic latent image bearer (may be also referred to as an image bearer), and a developing unit that are integrated, stores therein a toner, and is detachably mounted in an image forming apparatus. The process cartridge may further includes at least one selected from the group consisting of a charging unit, an exposing unit, and a cleaning unit.

When the toner stored unit of the present disclosure is mounted in an image forming apparatus to perform image formation, an image can be formed with utilizing characteristics of the toner that stable chargeability is exhibited over a long period of time, fluctuations in charging due to the environment are presented, and contamination inside a device due to toner scattering and photoconductor filming are prevented.

(Developer)

The developer of the present disclosure include the toner of the present disclosure and a carrier.

<Carrier>

The carrier includes carrier particles, each of which include a core and a resin layer covering the core and including particles.

The particles include barium sulfate particles, and an equivalent circle diameter of the barium sulfate particles is 400 nm or greater but 900 nm or less. A detectable amount of a barium atom of the carrier as measured by X-ray photoelectron spectroscopy (XPS) is preferably 0.3 atomic % or greater.

The carrier for use in the present disclosure satisfying the above-described conditions can appropriately control charge to give a desired image quality, and use of the carrier can supply a stably amount of a developer to a developing region, and continuous printing can be performed with an image density of a low imaging area by a high-speed device using the low-temperature fixing toner.

In the present disclosure, it is preferable that barium sulfate particles be included in the resin layer, and the Ba detectable amount at the resin layer surface as measured by XPS be 0.3 atomic % or greater. The barium sulfate particles can enhance chargeability of a resultant toner, and the barium sulfate particles present at the surface layer can maintain chargeability after outputting a large area of an image for a long period of time.

In addition, the equivalent circle diameter of the barium sulfate particles is preferably 400 nm or greater but 900 nm or less. Since the equivalent circle diameter of the barium sulfate particles is 400 nm or greater but 900 nm or less, the barium sulfate particles are present in the state of convex parts relative to a surface of the resin layer of the carrier particle. Since stress is always applied to the surface of the carrier particle on which the convex parts are formed with the barium sulfate particles inside a developing device by friction with a toner, other carrier particles, a developing screw, etc., a film spend on the carrier particle is immediately scraped by the above-mentioned stress, even if a binder resin, wax, or additives of the toner is temporarily spent on the carrier particle. Therefore, the barium sulfate particles are always maintained in an exposed state.

Meanwhile, a binder resin, wax, or additive of the toner is spend on concave parts created between convex parts of the barium sulfate particles. However, the materials spend are not accumulated because the carrier particles are identically electrically charged to the charge of the toner by being covered with the above-mentioned materials of the toner. The surface layer of the carrier particle, which is in the form of concave parts, cannot charge a toner due to the presence of the spent material of the toner, but a friction rate thereof with the toner is low because of the concave parts, and contribution thereof to charging of the toner is small. Accordingly, the sites forming the convex parts with the barium sulfate particles in the carrier particle determine chargeability of the carrier, and therefore, stable chargeability can be maintained over a long period of time.

Moreover, convex-concave shapes can be formed in the surface layer of the carrier particle by setting the equivalent circle diameter of the barium sulfate particles to the above-mentioned range. As a result, bulk density of the carrier is stabilized. Typically, a surface of a carrier particle is scraped, or a toner component is spent on a surface layer of a carrier particle, and therefore a bulk density of the carrier fluctuates. As a result, an amount of a developer taken up on a developing sleeve changes to change a supply amount of the developer to the developing region, and therefore there is a problem that developing performance fluctuates. Since the barium sulfate particles having the equivalent circle diameter of 400 nm or greater but 900 nm or less are included in the resin layer, an effect of suppressing fluctuations in bulk density of the carrier can be obtained as the spent material is accumulated in the concave parts. In addition, the film strength of the resin layer can be improved by dispersing the barium sulfate particles in the resin layer, and therefore an amount of the resin layer scraped can be reduced. Accordingly, fluctuations in bulk density of the carrier either due to the spent or the scraped amount of the resin layer are unlikely to occur, and therefore stable developing performance can be secured over a long period of time.

—Resin Layer—

The resin layer includes a resin and barium sulfate particles. In addition to the barium sulfate particles, moreover, the resin layer may include various conductive particles. In order to improve stability or durability of a resultant carrier over time, the resin layer may further include a silane coupling agent.

The resin layer is preferably free from defected parts in a film thereof, and preferably has the average thickness of 0.80 μm or greater but 1.50 μm or less. When the average thickness of the resin layer is 0.80 μm or greater, the barium sulfate particles can be securely held in the resin layer, and separation of the barium sulfate particles from the resin layer can be prevented. When the average thickness of the resin layer is 1.50 μm or less, moreover, the following problem can be prevented. Namely, the problem is that the barium sulfate particles are included inside the resin layer and sufficient chargeability cannot be exhibited.

——Barium Sulfate Particles——

Because of the reasons mentioned above, the equivalent circle diameter of the barium sulfate particles is preferably 400 nm or greater but 900 nm or less. In order to secure stable chargeability and developing performance, the equivalent circle diameter is more preferably 600 nm or greater. When the equivalent circle diameter of the barium sulfate particles is 900 nm or greater, the size of the barium sulfate particles is too large relative to the average thickness of the resin layer, and therefore the barium sulfate particles are easily separated from the resin layer. Therefore, the equivalent circle diameter of the barium sulfate particles is preferably 900 nm or less.

Barium (Ba) may be present at a surface of each barium sulfate particle. It is important that the barium sulfate particles are included in the resin layer in the embodiment that Ba is present at the surface of each barium sulfate particle. As described above, the barium sulfate particles exposed from the surface layer of the carrier particle contributes stably chargeability of the carrier. When the barium sulfate surface layer is covered with a material, such as tin, therefore, the barium sulfate particles are not sufficiently exposed from the surface layer and therefore sufficient chargeability cannot be secured. Accordingly, it is difficult to exhibit stable chargeability. Moreover, the exposed barium sulfate particles from the surface layer of the carrier particle can facilitate capturing of a supplied toner. It is assumed this is because the barium sulfate particles and the toner easily cause fraction to charge, which is a particularly effective to a toner in which the number of charged particles are reduced for low-temperature fixing. In the present specification, an embodiment where the barium is present at the surface of the carrier particle means that the barium sulfate particles are not covered with a material, such as tin, the barium sulfate particles occupy 90% or greater of the surface of the carrier particle. The barium sulfate particles may be monodisperse particles.

An amount of the barium sulfate particles is preferably 50% by mass or greater but less than 100% by mass relative to the resin included in the resin layer.

When the amount of the barium sulfate particles is 50% by mass or greater, the barium sulfate particles are sufficiently exposed from the resin layer surface and therefore a resultant toner can be sufficiently charged. When the amount of the barium sulfate particles are less than 100% by mass, chargeability a resultant carrier is appropriate and initial charge can be easily controlled.

——Resin——

The resin is not particularly limited and may be appropriately selected depending on the intended purpose.

——Other Components——

In addition to the above-mentioned resin and the barium sulfate particles, other components, such as conductive particles and a silane coupling agent, may be further included as components constituting the resin layer.

The resin layer may include conductive particles in order to adjust volume resistivity of a resultant carrier.

The conductive particles are not particularly limited. Examples of the conductive particles include carbon black, ITO, PTO, WTO, tin oxide, zinc oxide, and a conductive polymer, such as polyaniline. The above-listed examples may be used alone or in combination.

The resin layer may include a silane coupling agent in order to stably disperse the particles therein.

The silane coupling agent is not particularly limited and may be appropriately selected depending on the intended purpose. Examples of the silane coupling agent include γ-(2-aminoethyl)aminopropyltrimethoxysilane, γ-(2-amino-ethyl)aminopropylm ethyldimethoxysilane, γ-methacryloxypropyltrimethoxysilane, trimethoxy-N-β-(N-vinylbenzylaminoethyl)-γ-aminopropylsilane hydrochloride, γ-glycidoxypropyltrimethoxysilane, r-mercaptopropyltrimethoxysilane, methyltrimethoxysilane, methylethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl [3-(trimethoxysilyl)propyl]ammonium chloride, γ-chloropropylmethyldimethoxysilane, methylchlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl) ammonium chloride. The above-listed examples may be used alone or in combination.

Examples of commercial products of the silane coupling agent include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all available from TORAY ACE CO., LTD.).

An amount of the silane coupling agent is preferably 0.1% by mass or greater but 10% by mass or less relative to the resin. When the amount of the silane coupling agent is 0.1% by mass or greater, adhesion between the resin and the core or the conductive particles does not reduce and therefore the resin layer does not fall off after usage of a long period of time. When the amount thereof is 10% by mass or less, toner filming on a carrier does not occur after usable of a long period.

<<Cores>>

The cores are not particularly limited as long as the cores are magnetic. Examples thereof include: ferromagnetic metals, such as iron and cobalt; iron oxides, such as magnetite, hematite, and ferrite; various alloys and compounds; and resin particles where any of the above-listed magnetic materials is dispersed in a resin. Among the above-listed examples, Mn-based ferrite, Mn—Mg-based ferrite, Mn—Mg—Sr-based ferrite etc. are preferably in view of consideration to the environment.

<Production Method of Carrier>

A production method of the carrier is not particularly limited and may be appropriately selected depending on the intended purpose. The production method thereof is preferably a method where a coating layer forming solution including the resin and the filler is applied onto surfaces of the core particles using a fluid bed coater to produce a carrier. When the coating layer forming solution is applied, condensation of the resin included in the coating layer may be performed. The condensation of the resin included in the coating layer may be performed after applying the coating layer forming solution.

A method for condensation of the resin is not particularly limited and may be appropriately selected depending on the intended purpose. Examples thereof include a method where heat or light is applied to the coating layer forming solution to condense the resin.

<Properties of Carrier>

In the Ba analysis performed by X-ray photoelectron spectroscopy (XPS), the Ba detectable amount of the carrier is preferably 0.3 atomic % or greater.

The Ba detectable amount is more preferably 0.3 atomic % or greater but 2.0 atomic % or less, and even more preferably 0.3 atomic % or greater but 1.5 atomic % or less.

The heights d of the convex parts created by the exposed barium sulfate particles from the surface of the resin layer are preferably 200 nm or greater.

As described above, surfaces of the barium sulfate particles constituting the convex parts significantly contribute to charging of a toner. When the heights of the convex parts are low, however, the barium sulfate particles are embedded in a spent toner component. Therefore, chargeability of a carrier decreases, and the chargeability thereof cannot be stably exhibited. Accordingly, the average value of the heights d of the convex parts that are the maximum parts of the exposed barium sulfate particles is preferably 200 nm or greater.

In the carrier particle, moreover, a major axis of the maximum exposed area of the barium sulfate particle from the surface of the resin layer is preferably 300 nm or greater.

As described above, the surfaces of the barium sulfate particles constituting the convex parts significantly contribute charging of a toner, but the contact probability of the carrier to the toner decreases as an area of the convex part is small, and therefore the toner cannot be sufficiently charged. Therefore, the major axis of the maximum exposed area of the barium sulfate particle is preferably 300 nm or greater.

The volume average particle diameter of the carrier particles is preferably 28 μm or greater but 40 μm or less. When the volume average particle diameter of the carrier particles is 28 μm or greater, carrier deposition can be prevented. When the volume average particle diameter of the carrier particles is 40 μm or less, reduction in reproducibility of fine parts of an image can be prevented, and a precise image can be formed.

The carrier preferably has volume resistivity of 8 (Log Ω·cm) or greater but 16 (Log Ω·cm) or less. When the volume resistivity of the carrier is 8 (Log Ω·cm) or greater, deposition of carrier on a non-imaging area can be prevented. When the volume resistivity thereof is 16 (Log Ω·cm) or less, an edge effect can be secured.

<Measuring Methods of Various Properties of Carrier>

The above-described various properties of the carrier can be measured by the following methods.

[Ba Analysis by X-Ray Photoelectron Spectroscopy (XPS)]

A detectable amount of Ba on a surface of the carrier particle can be measured by means of AXIS/ULYRA (available from Shimadzu/KRATOS).

The beam irradiation range is about 900 μm×about 600 μm, and the region of 25 carrier particles×17 carrier particles is detected. Moreover, the penetration depth is 0 nm or greater but 10 nm or less, and a state near a surface of the carrier particle can be measured.

As specific measuring conditions, the measuring mode is Al: 1486.6 eV, the excitation source is monochrome (Al), the detection system is a spectrum mode, and a magnet lens is OFF.

Then, detected elements are determined by wide scanning. Subsequently, a peak is detected per detected element by narrow scanning. Thereafter, Ba (atomic %) relative to all of the detected elements is calculated using a peak analysis software installed in the device.

[Measuring Method of Equivalent Circle Diameter]

The equivalent circle diameter of the barium sulfate particle can be measured by the following method.

The carrier is mixed into an embedding resin (30 minutes curable epoxy resin, 2 liquid type, available from Devcon), and the resultant is left to stand overnight to cure. The cured product is turned into a rough cross-section sample by mechanical polishing. The cross-section thereof is finished by means of a cross-section polisher (SM-09010, available from JEOL Ltd.) at the acceleration voltage of 5.0 kV and the beam current of 120 μA. An image of the resultant is taken by means of a scanning electron microscope (Merlin, available from Carl Zeiss) at the acceleration voltage of 0.8 kV, and the magnification of 30,000 times. The taken image is read as a TIFF image, and equivalent circle diameters of 100 barium sulfate particles are measured by means of Image-Pro Plus available from Media Cybernetics. An average value of the measured values is determined.

[Measuring Method of Height d of Convex Part Created by Exposed Barium Sulfate Particle]

An average value of heights d of convex parts that are the maximum exposed sites of the barium sulfate particles can be measured by the following method.

The carrier is mixed into an embedding resin (30 minutes curable epoxy resin, 2 liquid type, available from Devcon), and the resultant is left to stand overnight to cure. The cured product is turned into a rough cross-section sample by mechanical polishing. The cross-section thereof is finished by means of a cross-section polisher (SM-09010, available from JEOL Ltd.) at the acceleration voltage of 5.0 kV and the beam current of 120 μA. An image of the resultant is taken by means of a scanning electron microscope (Merlin, available from Carl Zeiss) at the acceleration voltage of 0.8 kV, and the magnification of 10,000 times and 30,000 times. The taken image is read as a TIFF image, and the average film thickness of the carrier resin films of 100 carrier particles is measured by means of Image-Pro Plus available from Media Cybernetics. Moreover, the height d of the convex part at which the exposure of the barium sulfate is the maximum in one carrier particle is determined, and a difference between the height d and the average thickness is calculated. This calculation is performed on 100 carrier particles, and an average value thereof is determined as a height d of the convex part created by the exposed barium sulfate particle.

[Measuring Method of Major Axis of Maximum Exposed Area of Barium Surface Particle]

The major axis of the maximum exposed area of the barium sulfate particle is measured by the following method. A backscattered electron image is taken by means of a scanning electron microscope S-4200 available from Hitachi, Ltd. at application voltage of 1 KV, and magnification of 1,000 times. The taken image is read as a TIFF image, and converted into an image including only particles by means of Image-Pro Plus available from Media Cybernetics. Thereafter, image thresholding is performed to device the image into white areas (areas of the exposed barium sulfate) and black areas (areas covered with the resin), and a major axis of the white area is measured. Within one carrier particle, the largest value of the major axis is determined as a major axis of the maximum exposed area of that carrier particle. The measurement as described above is performed on 100 carrier particles, and an average value of the measured values is determined as a major axis of the maximum exposed area of the barium sulfate.

[Measuring Method of Volume Average Particle Diameter of Carrier Particles]

The volume average particle diameter of the carrier particles can be measured, for example, by means of Microtrack particle size distribution analyzer model HRA9320-X100 (available from NIKKISO CO., LTD.).

[Measuring Method of Volume Resistivity of Carrier]

The volume resistivity of the carrier can be measured in the following manner. First, a cell composed of a fluororesin container in which an electrode having a surface area of 2.5 cm×4 cm and another electrode are disposed with a distance of 0.2 cm between the electrodes is charged with the carrier. Tapping of the cell is performed 10 times with a falling height of 1 cm, and at tapping speed of 30 times/min. Next, DC voltage of 1,000 V was applied between the electrodes, and 30 seconds after the application of the voltage, a resistance value r [Ω] was measured by means of a high resistance meter 4329A (Yokokawa-Hewlett-Packard. Volume resistivity [Ω·cm] can be calculated according to the following mathematical formula 1.

$$r\times(2.5\times4)/0.2 \qquad \text{Mathematical formula 1}$$

The volume resistivity (Log Ω·cm) of the carrier is a common logarithm value of the volume resistivity [Ω·cm] obtained by the measurement above.

The developer of the present disclosure has excellent transfer properties and chargeability, and can stably form a high quality image. Note that, the developer may be a one-component developer or a two-component developer. When a high-speed printer corresponding to improved information processing speed in recent years, the developer is preferably a two-component developer because a service life thereof can be improved.

In the case where a one-component developer is used as the developer, particle diameters of the toner particles do not largely change even after the toner is consumed and then supplied, the toner filming on a developing roller is suppressed, fusion of the toner to a member, such as a blade for thinning a layer of the toner is suppressed, and excellent and stable developing and images can be obtained even when the developer is stirred in a developing device for a long period of time.

In the case where a two-component developer is used as the developer, particle diameters of the toner particles do not largely change even after the toner is consumed and then supplied to the developer over a long period of time, and excellent and stable developing and images are obtained even when the developer is stirred in a developing device for a long period of time.

When the developer is a two-component developer, a mixing ratio between the toner and the carrier in the two-component developer is that a mass ratio of the toner to the carrier is preferably 2.0% by mass or greater but 12.0% by mass or less, and more preferably 2.5% by mass or greater but 10.0% by mass or less.

(Developer Stored Unit)

The developer stored unit of the present disclosure includes the developer of the present disclosure and a container storing therein the developer.

When the developer stored unit of the present disclosure is mounted in an image forming apparatus to perform image formation, an image can be formed with utilizing characteristics of the toner that stable chargeability is exhibited over a long period of time with maintaining excellent heat resistant storage stability, fluctuations in charge due to the environment are presented, and contamination inside a device due to toner scattering and photoconductor filming are prevented.

(Image Forming Method and Image Forming Apparatus)

The image forming method of the present disclosure includes: an electrostatic latent image forming step, which includes forming an electrostatic latent image on an electrostatic latent image bearing member; a developing step, which includes developing the electrostatic latent image with the developer of the present disclosure to form a visible image; a transferring step, which includes transferring the visible image onto a recording medium; and a fixing step, which includes fixing the transfer image transferred onto the recording medium. The image forming method may further include appropriately selected other steps, such as a charge-eliminating step, a cleaning step, a recycling step, and a controlling step, according to the necessity.

The image forming apparatus of the present disclosure includes: an electrostatic latent image bearing member; an electrostatic latent image forming unit configured to form an electrostatic latent image on the electrostatic latent image bearing member; a developing unit configured to develop the electrostatic latent image with the developer of the present disclosure to form a visible image; a transferring unit configured to transfer the visible image onto a recording medium; and a fixing unit configured to fix a transfer image transferred onto the recording medium. The image forming apparatus may further include appropriately selected other units, such as a charge-eliminating unit, a cleaning unit, a recycling unit, and a controlling unit, according to the necessity.

<Electrostatic Latent Image Forming Step and Electrostatic Latent Image Forming Unit>

The electrostatic latent image forming step is a step including forming an electrostatic latent image on an electrostatic latent image bearer.

A material, shape, structure, size, etc., of the electrostatic latent image bearer (may be referred to as an "electrophotographic photoconductor" or a "photoconductor") are not particularly limited and may be appropriately selected from electrostatic latent image bearers known in the art. The shape thereof is dubitably a drum shape. Examples of the material thereof include: inorganic photoconductors, such as amorphous silicon and selenium; and organic photoconductors (OPC), such as polysilane and phthalopolymethine. Among the above-listed example, the organic photoconductor (OPC) is preferable because an image of higher resolution can be obtained.

For example, formation of the electrostatic latent image can be performed by uniformly charging a surface of the electrostatic latent image bearer, followed by exposing the surface to light imagewise, and can be performed by the electrostatic latent image forming unit.

For example, the electrostatic latent image forming unit includes at least a charging unit (a charger) configured to uniformly charge a surface of the electrostatic latent image bearer and an exposing unit (an exposure) configured to expose the surface of the electrostatic latent image bearer imagewise.

For example, the charging can be performed by applying voltage to a surface of the electrostatic latent image bearer using the charger.

The charger is not particularly limited and may be appropriately selected depending on the intended purpose. Examples of the charger include contact chargers, known in the art themselves, each equipped with a conductive or semiconductive roller, brush, film, or rubber blade, and non-contact chargers utilizing corona discharge, such as corotron, and scorotron.

The charger is preferably a charger that is disposed in contact with or without contact with the electrostatic latent image bearer and is configured to apply superimposed DC and AC voltage to charge a surface of the electrostatic latent image bearer.

Moreover, the charger is preferably a charger that is disposed close to the electrostatic latent image bearer via a gap tape without contacting with the electrostatic latent image bearer, and is configured to apply superimposed DC and AC voltage to the charging roller to charge a surface of the electrostatic latent image bearer.

For example, the exposure can be performed by exposing the surface of the electrostatic latent image bearer to light imagewise using the exposure.

The exposing unit is not particularly limited and may be appropriately selected depending on the intended purpose, as long as the exposure is capable of exposing the charged surface of the electrostatic latent image bearer to light in the shape of an image to be formed. Examples of the exposure include various exposing units, such as copy optical exposing units, rod lens array exposing units, laser optical exposing units, and liquid crystal shutter optical exposing units.

Note that, in the present disclosure, a back-exposure system may be employed. The back-exposure system is a system where imagewise exposure is performed from the back side of the electrostatic latent image bearer.

<Developing Step and Developing Unit>

The developing step is a step including developing the electrostatic latent image with the toner to form a visible image.

For example, formation of the visible image can be performed by developing the electrostatic latent image with the toner and can be performed by the developing unit.

For example, the developing unit is preferably a developing unit that stores the toner therein and includes at least a developing device capable of applying the toner to the electrostatic latent image directly or indirectly. The developing unit is more preferably a developing device etc. equipped with a toner stored container.

The developing device may be a developing device for a single color or a developing device for multiple colors. For example, the developing device is preferably a developing device including a stirrer configured to stir the toner to cause friction to thereby charge the toner, and a rotatable magnet roller.

Inside the developing device, for example, the toner and the carrier are mixed and stirred to cause frictions, the toner is charged by the frictions, and the charged toner is held on a surface of the rotating magnetic roller in the form of a brush to thereby form a magnetic brush. Since the magnetic roller is disposed adjacent to the electrostatic latent image bearer (photoconductor), part of the toner constituting the magnetic brush formed on the surface of the magnetic roller is transferred onto a surface of electrostatic latent image bearer (photoconductor) by electric suction force. As a result, the electrostatic latent image is developed with the toner to form a visible image formed of the toner on the surface of the electrostatic latent image bearer (photoconductor).

<Transferring Step and Transferring Unit>

The transferring step is a step including transferring the visible image to a recording medium. A preferable embodiment of the transferring step is an embodiment where an intermediate transfer member is used, the visible image is primary transferred onto the intermediate transfer member and then the visible image is secondary transferred onto the recording medium. A more preferable embodiment thereof is an embodiment using two or more colors of the toners, preferably full-color toners, and including a primary transfer step and a secondary transfer step, where the primary transfer step includes transferring visible images on the intermediate transfer member to form a composite transfer image, and the secondary transfer step includes transferring the composite transfer image onto the recording medium.

For example, the transfer can be performed by charging the visible image on the electrostatic latent image bearer (photoconductor) using a transfer charger. The transfer can be performed by the transferring unit. A preferable embodiment of the transferring unit is a transferring unit including a primary transferring unit configured to transfer visible images onto an intermediate transfer member to form a composite transfer image, and a secondary transferring unit configured to transfer the composite transfer image onto a recording medium.

Note that, the intermediate transfer member is not particularly limited and may be appropriately selected from transfer members known in the art depending on the intended purpose. Preferable examples of the intermediate transfer member include a transfer belt.

The transferring unit (the primary transferring unit and the secondary transferring unit) preferably includes at least a transferring unit configured to charge and release the visible image formed on the electrostatic latent image bearer (photoconductor) to the side of the recording medium. The number of the transferring unit may be one, or two or more.

Examples of the transferring unit include a corona transferring unit using corona discharge, a transfer belt, a transfer roller, a pressure transfer roller, and adhesion transferring unit.

Note that, the recording medium is not particularly limited and may be appropriately selected from recording media (recording paper) known in the art.

<Fixing Step and Fixing Unit>

The fixing step is a step including fixing the visible image transferred to the recording medium using the fixing device. The fixing step may be performed every time a visible image of each color of the developer is transferred. Alternatively, the fixing step may be performed once at the same time in a state visible images of all the colors of the developers are laminated.

The fixing device is not particularly limited and may be appropriately selected depending on the intended purpose. The fixing device is suitably any of heat pressure units known in the art. Examples of the heat pressure units include a combination of a heat roller and a pressure roller and a combination of a heat roller, a pressure roller, and an endless belt.

The fixing device is preferably a unit that includes a heating body equipped with a heat generator, a film in contact with the heating body, and a press member pressed against the heating body via the film, and is configured to pass a recording medium, on which an unfixed image is formed, between the film and the press member to heat-fixing the image onto the recording medium. Heating performed by the heat-press unit is generally preferably performed at a temperature of 80° C. or higher but 200° C. or lower.

In the present disclosure, in combination with or instead of the fixing step and the fixing unit, for example, a photofixing device known in the art may be used depending on the intended purpose.

<Other Steps and Other Units>

The charge-eliminating step is a step including applying charge elimination bias to the electrostatic latent image bearer to eliminate the charge. The charge-eliminating step can be suitably performed by the charge-eliminating unit.

The charge-eliminating unit is not particularly limited as long as the charge-eliminating unit is capable of applying charge-eliminating bias to the electrostatic latent image bearer, and may be appropriately selected from charge eliminators known in the art. For example, the charge-eliminating unit is preferably a charge-eliminating lamp etc.

The cleaning step is a step including removing the toner remained on the electrostatic latent image bearer. The cleaning step can be suitably performed by the cleaning unit.

The cleaning unit is not particularly limited as long as the cleaning unit is capable of removing the toner remained on the electrostatic latent image bearer, and may be appropriately selected from cleaners known in the art. Examples of the cleaning unit include a magnetic brush cleaner, an electrostatic brush cleaner, a magnetic roller cleaner, a blade cleaner, a brush cleaner, and a web cleaner.

The recycling step is a step including recycling the toner removed by the cleaning step to the developing unit. The recycling step can be suitably performed by the recycling unit. The recycling unit is not particularly limited and may be any of conveying units known in the art.

The controlling step is a step including controlling each of the above-mentioned steps. The controlling step can be suitably performed by the controlling unit.

The controlling unit is not particularly limited and may be appropriately selected depending on the intended purpose, as long as the controlling unit is capable of controlling operation of each of the above-mentioned units. Examples of the controlling unit include devices, such as a sequencer and a computer.

An example of the image forming apparatus of the present disclosure is illustrated in FIG. 1. The image forming apparatus 100A includes a photoconductor drum 10, a charging roller 20, an exposing device, a developing device 40, an intermediate transfer belt 50, a cleaning device 60 including a cleaning blade, and a charge-eliminating lamp 70.

The intermediate transfer belt 50 is an endless belt supported by 3 rollers 51 disposed inside the intermediate transfer belt 50 and can move in the direction indicated with the arrow in FIG. 1. Part of the 3 rollers 51 also functions as a transfer bias roller capable of applying transfer bias (primary transfer bias) to the intermediate transfer belt 50. Moreover, the cleaning device 90 including the cleaning blade is disposed adjacent to the intermediate transfer belt 50. Furthermore, the transfer roller 80 capable of applying transfer bias (secondary bias) to the transfer paper 95 to transfer the toner image is disposed to face the intermediate transfer belt 50.

At the periphery of the intermediate transfer belt 50, moreover, the corona charger 58 configured to apply charge to the toner image transferred to the intermediate transfer belt 50 is disposed between a contact area between the photoconductor drum 10 and the intermediate transfer belt 50 and a contact area between the intermediate transfer belt 50 and the transfer paper 95 along the rotational direction of the intermediate transfer belt 50.

The developing device 40 is composed of a developing belt 41, and a black developing unit 45K, a yellow developing unit 45Y, a magenta developing unit 45M, and a cyan developing unit 45C disposed together at the periphery of the developing belt 41. Note that, the developing unit 45 of each color includes a developer stored unit 42, a developer supply roller 43, and a developing roller (developer bearer) 44. Moreover, the developing belt 41 is an endless belt supported by a plurality of belt rollers, and can move in the direction indicated with the arrow in FIG. 1. Furthermore, part of the developing belt 41 is in contact with the photoconductor drum 10.

Next, a method for forming an image using the image forming apparatus 100A will be described. First, a surface of the photoconductor drum 10 is uniformly charged by the charging roller 20. Then, the photoconductor drum 10 is exposed to exposure light L by means of an exposing device (not illustrated) to form an electrostatic latent image. Next, the electrostatic latent image formed on the photoconductor drum 10 is developed with a toner supplied from the developing device 40, to thereby form a toner image. Moreover, the toner image formed on the photoconductor drum 10 is transferred (primary transferred) onto the intermediate transfer belt 50 by the transfer bias applied from the roller 51. Then, the toner image is transferred (secondary transferred) onto transfer paper 95 by the transfer bias applied from the transfer roller 80. Meanwhile, the toner remained on the surface of the photoconductor drum 10, from which the toner image has been transferred to the intermediate transfer belt 50, is removed by the cleaning device 60. Then, the charge of the photoconductor drum is eliminated by the charge-eliminating lamp 70.

Figure 2:
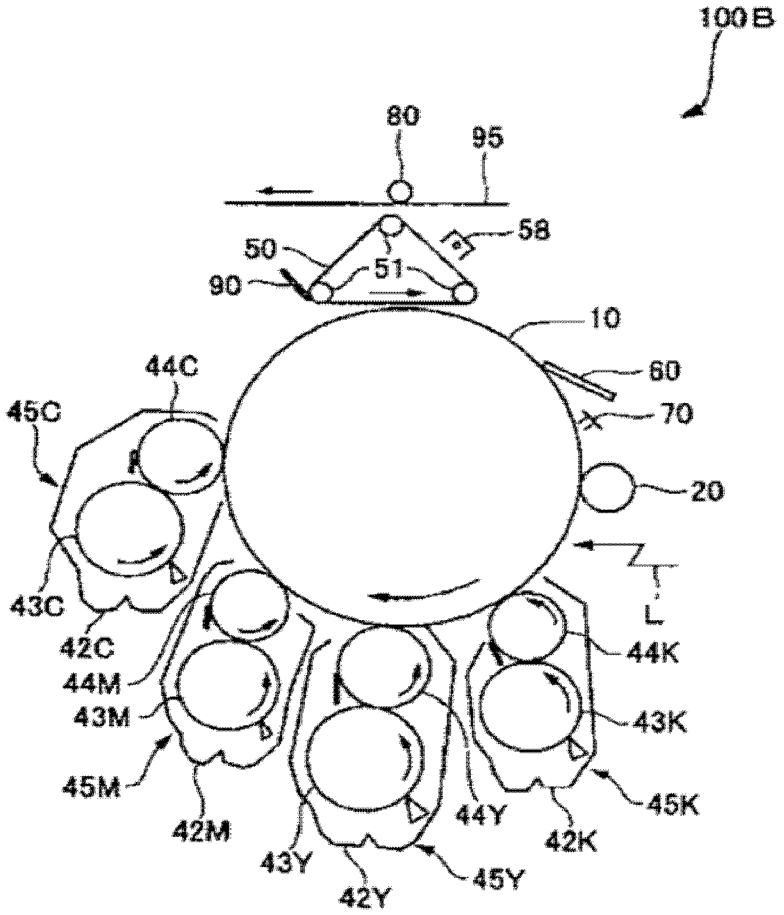
FIG. 2 is a schematic view illustrating another example of the image forming apparatus of the present disclosure.

A second example of the image forming apparatus for use in the present disclosure is illustrated in FIG. 2. The image forming apparatus 100B has the identical structure to the structure of the image forming apparatus 100A, except that a black developing unit 45K, a yellow developing unit 45Y, a magenta developing unit 45M, and a cyan developing unit 45C are disposed at the periphery of the photoconductor drum 10 to directly face the photoconductor drum 10 without disposing the developing belt 41.

Figure 3:
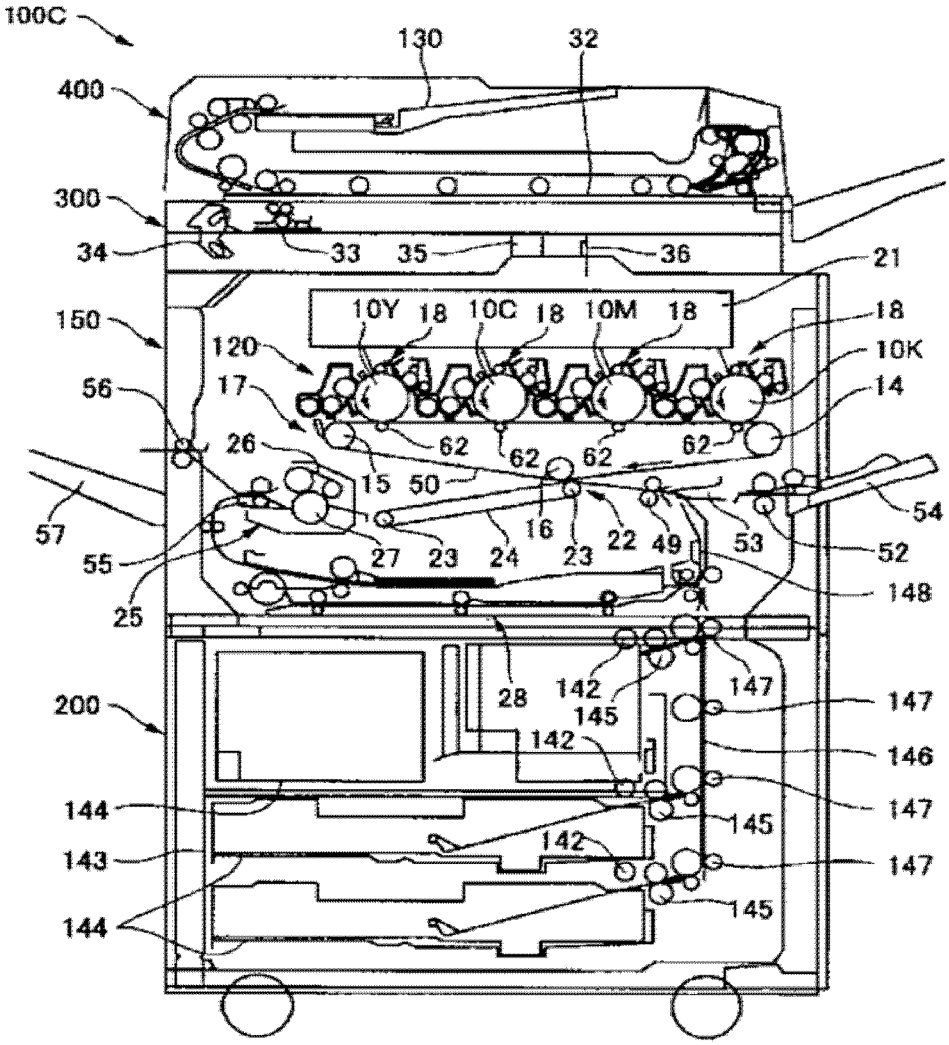
FIG. 3 is a schematic view illustrating an example of a tandem color image forming apparatus using the image forming apparatus of the present disclosure.

A third example of an image forming apparatus for use in the present disclosure is illustrated in FIG. 3. The image forming apparatus 100C is a tandem color image forming apparatus and includes a copier main body 150, a paper feeding table 200, a scanner 300, and an automatic document feeder (ADF) 400.

An intermediate transfer belt 50 disposed at a center of the copier main body 150 is an endless belt supported by three rollers 14, 15, and 16, and can move in the direction indicated with the arrow in FIG. 3. Near the roller 15, disposed is a cleaning device 17 having a cleaning blade configured to remove the toner remained on the intermediate transfer belt 50 from which the toner image has been transferred to recording paper. Yellow, cyan, magenta, and black image forming units 120Y, 120C, 120M, and 120K are aligned and disposed along the conveying direction to face a section of the intermediate transfer belt 50 supported by the rollers 14 and 15.

Moreover, an exposing device 21 is disposed near the image forming unit 120. Moreover, a secondary transfer belt 24 is disposed at the side of the intermediate transfer belt 50 opposite to the side thereof where the image forming unit 120 is disposed. Note that, the secondary transfer belt 24 is an endless belt supported by a pair of rollers 23. Recording paper transported on the secondary transfer belt 24 and the intermediate transfer belt 50 can be in contact with each other at the section between the roller 16 and the roller 23.

Moreover, a fixing device 25 is disposed near the secondary transfer belt 24, where the fixing device includes a fixing belt 26 that is an endless belt supported by a pair of rollers, and a pressure roller 27 disposed to press against the fixing belt 26. Note that, a sheet reverser 28 configured to reverse recording paper when images are formed on both sides of the recording paper is disposed near the secondary transfer belt 24 and the fixing device 25.

Next, a method for forming a full-color image using the image forming apparatus 100C will be explained. First, a color document is set on a document table 130 of the automatic document feeder (ADF) 400. Alternatively, the automatic document feeder 400 is opened, a color document is set on contact glass 32 of the scanner 300, and then automatic document feeder 400 is closed. In the case where the document is set on the automatic document feeder 400, once a start switch is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven to scan the document with the first carriage 33 and the second carriage 34. During the scanning operation, light emitted from the first carriage 33 is reflected by the surface of the document, the reflected light from the surface of the document is reflected by the second carriage 34, and then the reflected light is received by a reading sensor 36 via an image formation lens 35 to read the document, to thereby image information of black, yellow, magenta, and cyan.

Figure 4:
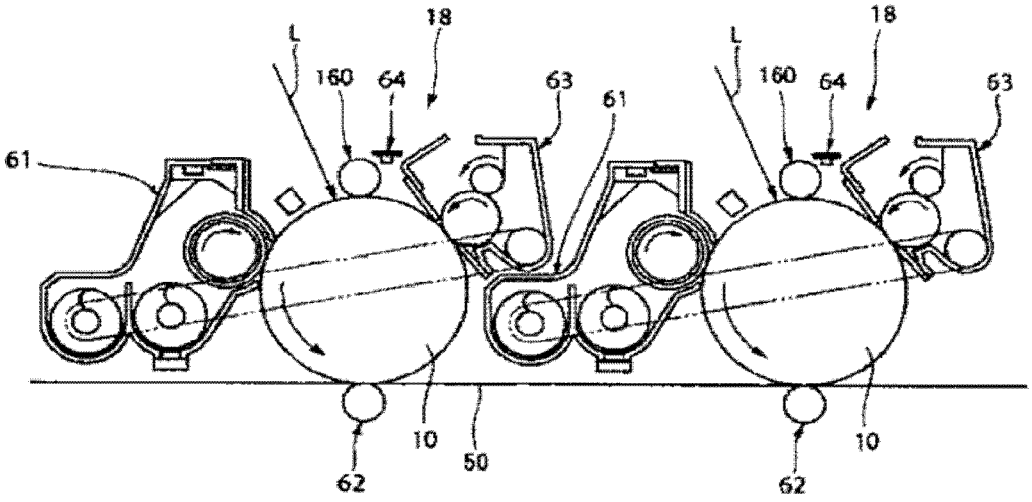
FIG. 4 is an enlarged view illustrating an example of the image forming unit of FIG. 3.

The image information of each color is transmitted to each image-forming unit 120 of each color to form a toner image of each color. As illustrated in FIG. 4, the image-forming unit 120 of each color includes a photoconductor drum 10, a charging roller 160 configured to uniformly charge the photoconductor drum 10, an exposing device configured to expose the photoconductor drum 10 to exposure light L based on the image information of each color to form an electrostatic latent image for each color, a developing device 61 configured to develop the electrostatic latent image with a developer of each color to form a toner image of each color, a transfer roller 62 configured to transfer the toner image onto an intermediate transfer belt 50, a cleaning device 63 including a cleaning blade, and a charge-eliminating lamp 64. The toner images of all of the colors formed by the image forming units 120 of all of the colors are sequentially transferred (primary transferred) onto the intermediate transfer belt 50 rotatably supported by the rollers 14, 15, and 16 to superimpose the toner images to thereby form a composite toner image.

In the paper feeding table 200, meanwhile, one of the paper feeding rollers 142 is selectively rotated to eject recording paper from one of multiple paper feeding cassettes 144 of the paper bank 143, pieces of the ejected recording paper are separated one by one by a separation roller 145 to send each recording paper to a paper feeding path 146, and then transported by a conveying roller 147 into a paper feeding path 148 within the copier main body 150. The recording paper transported in the paper feeding path 148 is then bumped against a registration roller 49 to stop. Alternatively, pieces of the recording paper on a manual-feeding tray 54 are ejected by rotating a paper feeding roller, separated one by one by a separation roller 52 to guide into a manual paper feeding path 53, and then bumped against the registration roller 49 to stop.

Note that, the registration roller 49 is generally earthed at the time of use, but it may be biased for removing paper dusts of the recording paper. Next, the registration roller 49 is rotated synchronously with the movement of the composite toner image on the intermediate transfer belt 50, to thereby send the recording paper between the intermediate transfer belt 50 and the secondary transfer belt 24. The composite toner image is then transferred (secondary transferred) to the recording paper. Note that, the toner remained on the intermediate transfer belt 50, from which the composite toner image has been transferred, is removed by the cleaning device 17.

The recording paper to which the composite toner image has been transferred is transported on the secondary transfer belt 24 and then the composite toner image is fixed thereon by the fixing device 25. Next, the traveling path of the recording paper is switched by a separation craw 55 and the recording paper is ejected to a paper ejection tray 57 by an ejecting roller 56. Alternatively, the traveling path of the recording paper is switched by the separation craw 55, the recording paper is reversed by the sheet reverser 28, an image is formed on a back side of the recording paper in the same manner, and then the recording paper is ejected to the paper ejection tray 57 by the ejecting roller 56.

The image forming apparatus and image forming method of the present disclosure can form a high quality image over a long period because of the image forming apparatus and the image forming method use the toner of the present disclosure, which has stable chargeability over a long period of time with maintaining excellent heat resistant storage stability, prevents fluctuations in charging due to the environment, and does not cause contamination inside a device due to toner scattering and photoconductor filming.

EXAMPLES

The present disclosure will be described more detail by way of Examples. However, the present disclosure should not be construed as being limited to these Examples.

In Examples below, a "liberation ratio of inorganic particles," "number average particle diameters of alumina and silica," and a "ratio (major axis diameter/minor axis diameter) of a fluorine-containing aluminium compound" were measured in the following manner.

<Liberation Ratio of Inorganic Particles>

The liberation ratio of the inorganic particles was measured in the following manner.

(1) First, 5 g of NOIGEN (ET-165, dispersion medium: water, available from DKS Co., Ltd.) was weighed in a 500 mL beaker. To the beaker, 300 mL of distilled water was added. Ultrasonic waves were applied to the resultant to dissolve NOIGEN. The resultant was transferred into a 1,000 mL volumetric flask and then was diluted (in the case that air bubbles were generated, the resultant was left to stand for a while). The resultant was made homogenous by applying ultrasonic waves, to thereby prepare a 0.5% by mass NOIGEN dispersion liquid.

(2) Next, 50 mL of the 0.5% by mass NOIGEN dispersion liquid and 3.75 g of the toner were added to a 100 mL screw vial, and the resultant mixture was mixed for 30 minutes by means of a ball mill.

(3) Next, ultrasonic energy was applied to the resultant for 1 minute by means of an ultrasonic homogenizer (device name: homogenizer, type: VCX750, CV33, available from Sonics & Materials, Inc.) with setting a dial to output of 50% under the following conditions to disperse the mixture.

—Ultrasonic Wave Conditions—

Vibration duration: continuous 60 seconds

Amplitude: 40 W (50%)

Temperature: 25° C.

(4) Next, the obtained dispersion liquid was subjected to vacuum filtration with filter paper (product name: No. 5C, available from Advantec Toyo Kaisha, Ltd.). The resultant was washed twice with ion-exchanged water, followed by performing filtration. After removing the free inorganic particles that had been detached from the toner base particles, the toner was dried.

(5) A mass of the inorganic particles before and after removing the inorganic particles was measured by calculating a mass (% by mass) from the intensity (or a difference in the intensity before and after removing the inorganic particles) on a calibration curve by means of an X-ray fluorescence spectrometer (ZSX Primus IV, available from Rigaku Corporation).

The silica and alumina of the toner were determined by X-ray fluorescence spectroscopy.

The amount (% by mass) of the silica and the amount (% by mass) of the alumina were determined by the following device under the following conditions in the present disclosure.

A toner (3.00 g) was formed into a pellet having a diameter of 3 mm and a thickness of 2 mm, to thereby prepare a measurement sample toner.

Next, an amount of the Si element and an amount of the Al element in the pellet sample were measured by quantitative analysis performed by means of an X-ray fluorescence spectrometer. At the time of measurement, collection was performed using silica and alumina standard samples (available from Rigaku Corporation) to calculate the amounts of the silica and alumina.

Measuring device: ZSX Primus IV, available from Rigaku Corporation

X-ray tube: Rh

X-ray tube voltage: 50 kV

X-ray tube current: 10 mA

Next, a liberation ratio (%) of the inorganic particles was determined from the mass of the inorganic particles of the toner before and after the dispersion measured by (1) to (5) above according to the mathematical formula 1 below.

Liberation ratio (%) of inorganic particles=[(mass of inorganic particles before dispersion−mass of residual inorganic particles after dispersion)/mass of inorganic particles before dispersion]×100 [Mathematical Formula 1]

In the same manner as described above, the mass of alumina or silica of the toner before and after dispersion was determined, and a liberation ratio of the alumina and a liberation ratio of the silica were determined according to the following mathematical formulae 2 and 3, respectively. Note that, a liberation ratio of the silica and a liberation ratio of the alumina were determined by calculating a mass (% by mass) of Si and Al before and after removing the inorganic particles from the intensity on a calibration curve by means of an X-ray fluorescence spectrometer.

Liberation ratio (%) of Alumina=[(mass of alumina before dispersion−mass of residual alumina after dispersion)/mass of alumina before dispersion]×100 [Mathematical Formula 2]

Liberation ratio (%) of silica=[(mass of silica before dispersion−mass of residual silica after dispersion)/mass of silica before dispersion]×100 [Mathematical Formula 3]

<Measuring Method of Number Average Particle Diameters of Alumina and Silica>

The number average particle diameter of the particles of the alumina and the number average particle diameter of the particles of silica were measured by obtaining a SEM image of the particles of the alumina and a SEM image of the particles of silica using a field emission scanning electron microscope (FE-SEM) (SU8230, available from Hitachi High-Technologies Corporation), and measuring the number average particle diameters through image analysis.

First, the particles of the alumina or silica were dispersed in tetrahydrofuran, followed by removing the solvent to dry and solidify on a substrate. The resultant sample was observed under the FE-SEM to obtain an image, and the maximum length of each of secondary particles was measured. An average value of the 200 particles was calculated and was determined as the number average particle diameter. The measuring conditions of the FE-SEM were as follows.

[Measuring conditions of FE-SEM]

Acceleration voltage: 2.0 kV

Working distance (WD): 10.0 mm

Observation magnification: 50,000 times

<Measurement of Ratio (Major Axis Diameter/Minor Axis Diameter) of Particle of Fluorine-Containing Aluminium Compound>

The ratio (major axis diameter/minor axis diameter) of each of the particles of the fluorine-containing aluminium compound was measured by obtaining a SEM image of the particles of the fluorine-containing aluminium compound using a field emission scanning electron microscope (FE-SEM) (SU8230, available from Hitachi High-Technologies Corporation), and measuring a ratio (major axis diameter/minor axis diameter) of each of the particles of the fluorine-containing aluminium compound through image analysis.

First, the particles of the fluorine-containing aluminium compound were dispersed in tetrahydrofuran, followed by removing the solvent to dry and solidify on a substrate. The resultant sample was observed under the FE-SEM to obtain an image, and a length of the major axis and a length of the minor axis of each of the second particles were measured. An average value of the 200 particles was calculated and was determined as the ratio (major axis diameter/minor axis diameter). The measuring conditions of the FE-SEM were as follows.

[Measuring Conditions of FE-SEM]

Acceleration voltage: 2.0 kV

Working distance (WD): 10.0 mm

Observation magnification: from 50,000 times through 100,000 times (Synthesis of Ketimine 1)

A reaction vessel equipped with a stirring rod and a thermometer was charged with 170 parts by mass of isophoronediamine and 75 parts by mass of methyl ethyl ketone, and the resultant mixture was allowed to react for 5 hours at 50° C. to thereby obtain Ketimine 1. Ketimine 1 obtained had an amine value of 418 mgKOH/g.

(Synthesis of Amorphous Polyester Prepolymer A)

A reaction vessel equipped with a cooling tube, a stirrer, and a nitrogen-inlet tube was charged with 3-methyl-1,5-pentanediol, adipic acid, and trimellitic acid anhydride. At this time, a molar ratio of the hydroxyl groups to the carboxyl groups was set to 1.5, the amount of the trimellitic acid anhydride in the total amount of the monomers was set to 1 mol %, and titanium tetraisopropoxide was added in the amount 1,000 ppm relative to the total amount of the monomers. Subsequently, the resultant mixture was heated to 200° C. for about 4 hours, then heated to 230° C. for 2 hours, and the mixture was allowed to react until no more water was discharged. Thereafter, the resultant was reacted for 5 hours under the reduced pressure of from 10 mmHg through 15 mmHg, to thereby obtain amorphous polyester including a hydroxyl group.

A reaction vessel equipped with a cooling tube, a stirrer, and a nitrogen-inlet tube was charged with the Amorphous Polyester A-1 including a hydroxyl group and isophorone diisocyanate. At this time, a molar ratio of the isocyanate groups to the hydroxyl groups was set to 2.0. After diluting the mixture with ethyl acetate, the resultant was allowed to react for 5 hours at 100° C., to thereby obtain a 50% by mass Amorphous Polyester Prepolymer A-1 ethyl acetate solution.

A reaction vessel equipped with a heating device, a stirrer, and a nitrogen-inlet tube was charged with the 50% by mass Amorphous Polyester Prepolymer A-1 ethyl acetate solution and the solution was stirred. Thereafter, Ketimine 1 was added through dripping. At the time of the addition of Ketimine 1, a molar ratio of the amino groups relative to the isocyanate groups was set to 1.

After stirring the resultant for 10 hours at 45° C., the resultant was dried at 50° C. under reduced pressure until a residual amount of the ethyl acetate was to be 100 ppm or less, to thereby obtain Amorphous Polyester A-1. Amorphous Polyester A-1 obtained had a glass transition temperature of −55° C., and the weight average molecular weight of 130,000.

(Synthesis of Amorphous Polyester B)

A reaction vessel equipped with a nitrogen-inlet tube, a dehydration tube, a stirrer, and a thermocouple was charged with a bisphenol A ethylene oxide (2 mol) adduct (BisA-EO), a bisphenol A propylene oxide (3 mol) adduct (BisA-PO), terephthalic acid, and adipic acid. At this time, a molar ratio of BisA-EO to BisA-PO was set to 40/60, a molar ratio of the terephthalic acid to the adipic acid was set to 93/7, a molar ratio of the hydroxyl groups to the carboxyl groups was set to 1.2, and titanium tetraisopropoxide in the amount of 500 ppm was added relative to the total amount of monomers.

After reacting the resultant mixture for 8 hours at 230° C., the resultant was allowed to react for 4 hours under the reduced pressure of from 10 mmHg through 15 mmHg. Moreover, trimellitic acid anhydride was added in the amount of 1 mol % relative to the total amount of the monomers. Then, the resultant mixture was allowed to react for 3 hours at 180° C., to thereby obtain Amorphous Polyester B. Amorphous Polyester B obtained had a glass transition temperature of 67° C., and the weight average molecular weight of 10,000.

(Synthesis of Crystalline Polyester C)

A reaction vessel equipped with a nitrogen-inlet tube, a dehydration tube, a stirrer, and a thermocouple was charged with sebacic acid, and 1,6-hexanediol. At this time, a molar ratio of the hydroxyl groups to the carboxyl groups was set to 0.9, and titanium tetraisopropoxide was added in the amount of 500 ppm relative to the total amount of the monomers.

After reacting the resultant mixture for 10 hours at 180° C., the resultant was heated to 200° C., and was allowed to react for 3 hours. Moreover, the resultant was allowed to react for 2 hours under the reduced pressure of 8.3 kPa, to thereby obtain Crystalline Polyester C-1. Crystalline Polyester C-1 obtained had a melting point of 67° C., and the weight average molecular weight of 25,000.

<Measurements of Melting Point and Glass Transition Temperature>

A melting point and a glass transition temperature were measured by means of a differential scanning calorimeter (Q-200, available from TA Instruments Inc.). Specifically, about 5.0 mg of a target sample was placed in an aluminium sample container, the sample container as placed on a holder unit, and then the holder unit was set in an electric furnace. Next, the sample was heated from −80° C. to 150° C. at the heating speed of 10° C./min in a nitrogen atmosphere.

A glass transition temperature of the target sample was determined from the obtained DSC curve using an analysis program in the differential scanning calorimeter.

Moreover, an endothermic peak top temperature of the target sample was determined from the obtained DSC curve using an analysis program in the differential scanning calorimeter, and was determined as a melting point of the target sample.

<Measurement of Weight Average Molecular Weight>

A weight average molecular weight was measured by means of a gel permeation chromatography (GPC) measuring device (HLC-8220GPC, available from Tosoh Corporation), and a column (TSKgel Super HZM-H 15 cm triple column, available from Tosoh Corporation). Specifically, the column was stabilized in a heat chamber of 40° C. Next, tetrahydrofuran (THF) was introduced into the column at a flow rate of 1 mL/min. A 0.05% by mass through 0.6% by mass sample THF solution in the amount of from 50 μL through 200 μL was injected to measure a weight average molecular weight of the sample. The number average molecular weight of the sample was calculated from the correlation between the logarithmic values and the number of counts of the calibration curve that had been prepared using monodisperse polystyrene standard samples.

As the standard polystyrene samples, samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (available from Pressure Chemical or Tosoh Corporation) were used.

Moreover, a refractive index (RI) detector was used as a detector.

Example 1

<Production of Master Batch 1>

Water (1,200 parts), 500 parts of carbon black (product name: Printex35, available from Degussa, DBP oil absorption: 42 mL/100 mg, pH: 9.5), and 500 parts of Amorphous Polyester Resin B were added together and the resultant mixture was mixed by means of HENSCHEL MIXER (available from Nippon Cole & Engineering Co., Ltd.). After kneading the mixture for 30 minutes at 150° C. using a twin-roller kneader, then rolled and cooled, followed by pulverizing the resultant to obtain Master Batch 1.

<Synthesis of Wax Dispersing Agent 1>

An autoclave reaction tank equipped with a thermometer and a stirrer was charged with 480 parts by mass of xylene, and 100 parts by mass of polyethylene Sanwax 151P (available from Sanyo Chemical Industries, Ltd.) having a melting point of 108° C., and the weight average molecular weight of 1,000. Then, the polyethylene was dissolved and nitrogen purging was performed.

Next, to the resultant solution, a mixed solution including 805 parts by mass of styrene, 50 parts by mass of acrylonitrile, 45 parts by mass of butyl acrylate, 36 parts by mass of di-t-butylperoxide, and 100 parts by mass of xylene was added by dripping for 3 hours, and polymerization was performed at 170° C., and the temperature was maintained for 30 minutes. Thereafter, the solvent was removed, to thereby obtain Wax Dispersion Agent 1. Wax Dispersing Agent 1 obtained had a glass transition temperature of 65° C., and the weight average molecular weight of 18,000.

<Preparation of Wax Dispersion Liquid 1>

A vessel equipped with a stirring rod and a thermometer was charged with 300 parts by mass of paraffin wax having a melting point of 75° C. (HNP-9, available from Nippon Seiro Co., Ltd.), 150 parts by mass of Wax Dispersing Agent 1, and 1,800 parts by mass of ethyl acetate.

Next, the resultant mixture was heated to 80° C. with stirring and the temperature was maintained for 5 hours, followed by cooling to 30° C. over 1 hour. Moreover, the resultant was dispersed by means of a bead mill (ULTRA VISCOMILL, available from AIMEX CO., Ltd.) under the conditions that zirconia beads each having a diameter of 0.5 mm were packed in the amount of 80% by volume, and the number of passes was 3, to thereby obtain Wax Dispersion Liquid 1. During the dispersion, a liquid feeding rate was set to 1 kg/hr and a disk circumferential velocity was set to 6 m/sec.

<Preparation of Crystalline Polyester Dispersion Liquid 1>

A vessel equipped with a stirring rod and a thermometer was charged with 308 parts by mass of Crystalline Polyester C and 1,900 parts by mass of ethyl acetate. Next, the resultant mixture was heated to 80° C. with stirring and the temperature was maintained for 5 hours, followed by cooling to 30° C. over 1 hour. Moreover, the resultant was dispersed by means of a bead mill (ULTRA VISCOMILL, available from AIMEX CO., Ltd.) under the conditions that zirconia beads each having a diameter of 0.5 mm were packed in the amount of 80% by volume, and the number of passes was 3, to thereby obtain Crystalline Polyester Dispersion Liquid 1. During the dispersion, a liquid feeding rate was set to 1 kg/hr and a disk circumferential velocity was set to 6 m/sec.

<Preparation of Oil Phase 1>

A vessel was charged with 225 parts by mass of Wax Dispersion Liquid 1, 40 parts by mass of a 50% by mass Amorphous Polyester Prepolymer A ethyl acetate solution, 390 parts by mass of Amorphous Polyester B, 60 parts by mass of Master Batch 1, and 285 parts by mass of ethyl acetate. Thereafter, the resultant mixture was mixed by means of TK Homomixer (available from PRIMIX Corporation) for 60 minutes at 7,000 rpm, to thereby obtain Oil Phase 1.

<Synthesis of Vinyl-Based Resin Dispersion Liquid 1>

A reaction vessel equipped with a stirring rod and a thermometer was charged with 683 parts by mass of water, 11 parts by mass of sodium salt of sulfuric acid ester of methacrylic acid-ethylene oxide adduct (ELEMINOL RS-30, available from Sanyo Chemical Industries, Ltd.), 138 parts by mass of styrene, 138 parts by mass of methacrylic acid, and 1 part by mass of ammonium persulfate. Then, the resultant mixture was stirred for 15 minutes at 400 rpm to obtain a white emulsion. After heating the temperature of the internal system to 75° C., and reacting the white emulsion for 5 hours, 30 parts by mass of a 1% by mass ammonium persulfate aqueous solution was added, and the resultant was matured for 5 hours at 75° C., to thereby obtain Vinyl-Based Resin Dispersion Liquid 1. The dispersed elements in Vinyl-Based Dispersion Liquid 1 had the volume average particle diameter of 0.14 μm.

Note that, the volume average particle diameter of Vinyl-Based Resin Dispersion Liquid 1 was measured by means of Laser diffraction/scattering particle size distribution analyzer LA-920 (available from HORIBA, Ltd.).

<Preparation of Aqueous Phase 1>

Water (990 parts by mass), 83 parts by mass of Vinyl-Based Resin Dispersion Liquid 1, 37 parts by mass of a 48.5% by mass sodium dodecyldiphenyl ether disulfonate aqueous solution (ELEMINOL MON-7, available from Sanyo Chemical Industries, Ltd.), and 90 parts by mass of ethyl acetate were mixed and stirred, to thereby milky white Aqueous Phase 1.

<Emulsification and Removal of Solvent>

To the vessel in which Oil Phase 1 was placed, 1, 0.2 parts by mass of Ketimine 1 and 1,200 parts by mass of Aqueous Phase 1 were added. The resultant mixture was mixed by means of TK Homomixer for 20 minutes at 13,000 rpm, to thereby obtain Emulsified Slurry 1.

A vessel equipped with a stirrer and a thermometer was charged with Emulsified Slurry 1, and the solvent therein was removed 8 hours at 30° C. Thereafter, the resultant was matured for 4 hours at 45° C., to thereby obtain Dispersion Slurry 1.

<Washing, Heat Treatment, and Drying>

After filtering 100 parts by mass of Dispersion Slurry 1 under the reduced pressure, the following processes were performed. To the resultant filtration cake, 100 parts by mass of ion-exchanged water was added, and the resultant mixture was mixed by means of TK Homomixer for 10 minutes at 12,000 rpm, followed by filtering the mixture (the process as described may be referred to as a washing step (1) hereinafter). To the resultant filtration cake, 100 parts by mass of a 10% by mass sodium hydroxide aqueous solution was added, and the resultant mixture was mixed by means of TK Homomixer for 30 minutes at 12,000 rpm, followed by filtering the mixture under the reduced pressure (the process as described may be referred to as a washing step (2) hereinafter). Next, to the resultant filtration cake, 100 parts by mass of 10% by mass hydrochloric acid was added, and the resultant mixture was mixed by means of TK Homomixer for 10 minutes at 12,000 rpm, followed by filtering the mixture (the process as described may be referred to as a washing step (3) hereinafter). To the resultant filtration cake, moreover, 300 parts by mass of ion-exchanged water was added, and the resultant mixture was mixed by means of TK Homomixer for 10 minutes at 12,000 rpm, followed by filtering the mixture (the process as described may be referred to as a washing step (4) hereinafter). The washing steps (1) to (4) were performed twice.

To the resultant filtration cake, 100 parts by mass of ion-exchanged water was added. The resultant mixture was mixed by means of TK Homomixer for 10 minutes at 12,000 rpm. A heat treatment was performed on the resultant for 4 hours at 50° C., followed by filtering the resultant.

After drying the resultant filtration cake by means of an air-circulating drier for 48 hours at 45° C. Then, the resultant was passed through a sieve with a mesh size of 75 μm, to thereby obtain toner base particles.

<Mixing Step>

Into 20 L HENSCHEL MIXER (available from Nippon Cole & Engineering Co., Ltd.), 100 parts by mass of the toner base particles, and 0.5 parts by mass of Alumina 1 obtained in the following manner. The resultant mixture was mixed for 3 minutes at circumferential velocity of 40 m/s. Thereafter, 2 parts by mass of NX90G (available from NIPPON AEROSIL CO., LTD.) was further added, and the resultant mixture was mixed for 17 minutes at circumferential velocity of 40 m/s. The resultant mixture was passed through a sieve with a mesh size of 500, to thereby obtain a toner.

—Preparation of Alumina 1—

A reaction tank was charged with alumina having a BET specific surface area of 14.5 $m^2/g$ (TM-5D, available from TAIMEI CHEMICALS CO., LTD.). While stirring the alumina powder in a nitrogen atmosphere, a mixed solution including 10 g of heptadecafluorodecyltrimethoxysilane (KBM-7803, available from Shin-Etsu Chemical Co., Ltd.) and 2 g of hexamethyldisilazane was sprayed to 100 g of the alumna powder. The resultant was heated and stirred for 120 minutes at 200° C., followed by cooling, to thereby obtain Alumina 1.

Production Example 1 of Carrier

Twenty parts by mass (solid content: 100 parts by mass) of a methacryl-based copolymer having the weight average molecular weight (Mw) of 35,000 obtained in Resin Synthesis Example 1 below, 100 parts by mass (solid content: 20% by mass) of a silicone resin (SR2410, available from Dow Corning Toray Silicone Co., Ltd.) solution, 3.0 parts by mass (solid content: 100 parts by mass) of aminosilane, 36 parts by mass of alumina particles (equivalent circle diameter: 600 nm) and 60 parts by mass of oxygen-defected tin particles (available from MITSUI MINING & SMELTING CO., LTD., primary particle diameter: 30 nm) both serving as particles, and 2 parts by mass of titanium diisopropoxybis (ethylacetoacetate) TC-750 (available from Matsumoto Fine Chemical Co., Ltd.) serving as a catalyst were diluted with toluene to thereby obtain a resin solution having a solid content of 20% by mass.

Mn ferrite particles having the weight average particle diameter of 35 μm were used as cores. The resin solution was applied onto surfaces of the cores by means of a fluid bed coater equipped with nozzles for fine granulation. The application of the resin solution was performed and the applied film was dried in the manner that the average film thickness of the resultant resin layer was to be 1.00 μm, and the temperature inside the fluid bed was controlled to be 60° C. The obtained carrier was fired in an electric furnace for 1 hour at 210° C., to thereby obtain Carrier 1.

Synthesis Example 1 of Resin

A flask equipped with a stirrer was charged with 300 g of toluene, and the toluene was heated to 90° C. under a flow of nitrogen gas. Next, to the flask, a mixture including 84.4 g (200 mmol) of 3-methacryloxypropyltris(trimethylsiloxy) silane (Silaplane TM-0701T, CHISSO CORPORATION) represented by $CH_2{=}CMe\text{-}COO{-}C_3H_6{-}Si(OSiMe_3)_3$ (with the proviso that, Me is a methyl group), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was added by dripping over 1 hour. After completing the dripping, a solution obtained by dissolving 0.06 g (0.3 mmol) of 2,2'-azobis-2-methylbutyronitrile in 15 g of toluene was further added (a total amount of 2,2'-azobis-2-methylbutyronitrile: 0.64 g=3.3 mmol). The resultant mixture was mixed for 3 hours at a temperature of from 90° C. through 100° C. to undergo a radical copolymerization, to thereby obtain a methacryl-based copolymer.

<Production of Developer>

A two-component developer was produced using the toner obtained in Example 1 in the following manner. With 193 parts by mass of the carrier above, 7 parts by mass of the toner was homogeneously mixed by means of TURBULA mixer (available from Willy A. Bachofen (WAB) AG Maschinenfabrik), where the container thereof was rolled to perform stirring, for 5 minutes at 67 rpm to charge, to thereby produce a two-component developer.

Example 2

A toner was obtained in the same manner as in Example 1, except that, in <Mixing step> of Example 1, the mixing duration after adding 0.5 parts by mass of Alumina 1 was changed from 3 minutes to 5 minutes, and the mixing duration after adding 2 parts by mass of NS90G (available from NIPPON AEROSIL CO., LTD.) was changed from 17 minutes to 14 minutes. Moreover, a developer was produced in the same manner as in Example 1.

Example 3

A toner was obtained in the same manner as in Example 1, except that, in <Mixing step> of Example 1, the mixing duration after adding 0.5 parts by mass of Alumina 1 was changed from 3 minutes to 1 minute, and the mixing duration after adding 2 parts by mass of NS90G (available from NIPPON AEROSIL CO., LTD.) was changed from 17 minutes to 20 minutes. Moreover, a developer was produced in the same manner as in Example 1.

Example 4

A toner was obtained in the same manner as in Example 1, except that, in <Mixing step> of Example 1, the circumferential velocity and mixing duration after adding 0.5 parts by mass of Alumina 1 were changed from 40 m/s to 35 m/s and from 3 minutes to 5 minutes, respectively, and the mixing duration after adding 2 parts by mass of NS90G (available from NIPPON AEROSIL CO., LTD.) was changed from 17 minutes to 10 minutes. Moreover, a developer was produced in the same manner as in Example 1.

Example 5

A toner was obtained in the same manner as in Example 1, except that, in <Mixing step> of Example 1, the circumferential velocity and mixing duration after adding 0.5 parts by mass of Alumina 1 were changed from 40 m/s to 35 m/s and from 3 minutes to 2 minutes, respectively, and the mixing duration after adding 2 parts by mass of NS90G (available from NIPPON AEROSIL CO., LTD.) was changed from 17 minutes to 3 minutes. Moreover, a developer was produced in the same manner as in Example 1.

Example 6

A toner was obtained in the same manner as in Example 1, except that, in <Mixing step> of Example 1, the circumferential velocity and mixing duration after adding 0.5 parts by mass of Alumina 1 were changed from 40 m/s to 30 m/s and from 3 minutes to 5 minutes, respectively, and the mixing duration after adding 2 parts by mass of NS90G (available from NIPPON AEROSIL CO., LTD.) was changed from 17 minutes to 7 minutes. Moreover, a developer was produced in the same manner as in Example 1.

Example 7

A toner was obtained in the same manner as in Example 1, except that, in <Mixing step> of Example 1, the circumferential velocity and mixing duration after adding 0.5 parts by mass of Alumina 1 were changed from 40 m/s to 35 m/s and from 3 minutes to 4 minutes, respectively, and the mixing duration after adding 2 parts by mass of NS90G (available from NIPPON AEROSIL CO., LTD.) was changed from 17 minutes to 1 minute. Moreover, a developer was produced in the same manner as in Example 1.

Example 8

A toner was obtained in the same manner as in Example 5, except that in <Mixing step> of Example 5, Alumina 1 was replaced with Alumina 2. Moreover, a developer was produced in the same manner as in Example 1.

—Preparation of Alumina 2—

A reaction tank was charged with alumina having a BET specific surface area of 100 $m^2/g$ (Aluminium oxide C, available from Degussa). White stirring the alumina powder in a nitrogen atmosphere, a mixed solution including 10 g of heptadecafluorodecyltrimethoxysilane (KBM-7803, available from Shin-Etsu Chemical Co., Ltd.) and 2 g of hexamethyldisilazane was sprayed to 100 g of the alumna powder. The resultant was heated and stirred for 120 minutes at 200° C., followed by cooling, to thereby obtain Alumina 2.

Example 9

A toner was obtained in the same manner as in Example 8, except that in <Mixing step> of Example 8, Alumina 2 was replaced with Alumina 3. Moreover, a developer was produced in the same manner as in Example 1.

—Preparation of Alumina 3—

A reaction tank was charged with alumina having a BET specific surface area of 73 $m^2/g$ (AKP-G07, available from SUMITOMO CHEMICAL COMPANY, LIMITED). While stirring the alumina powder in a nitrogen atmosphere, a mixed solution including 10 g of heptadecafluorodecyltrimethoxysilane (KBM-7803, available from Shin-Etsu Chemical Co., Ltd.) and 2 g of hexamethyldisilazane was sprayed to 100 g of the alumna powder. The resultant was heated and stirred for 120 minutes at 200° C., followed by cooling, to thereby obtain Alumina 3.

Example 10

A toner was obtained in the same manner as in Example 9, except that in <Mixing step> of Example 9, Alumina 3 was replaced with Alumina 4. Moreover, a developer was produced in the same manner as in Example 1.

—Preparation of Alumina 4—

A reaction tank was charged with alumina having a BET specific surface area of 58 $m^2/g$ (AKP-G07, available from SUMITOMO CHEMICAL COMPANY, LIMITED). While stirring the alumina powder in a nitrogen atmosphere, a mixed solution including 10 g of heptadecafluorodecyltrimethoxysilane (KBM-7803, available from Shin-Etsu Chemical Co., Ltd.) and 2 g of hexamethyldisilazane was sprayed to 100 g of the alumna powder. The resultant was heated and stirred for 120 minutes at 200° C., followed by cooling, to thereby obtain Alumina 4.

Example 11

In <Mixing step> of Example 1, 100 parts by mass of the toner base particles and 2 parts by mass of TG-C110 (available from Cabot Specialty Chemicals Inc.) were added into 20 L HENSCHEL MIXER (available from Nippon Cole & Engineering Co., Ltd.). The resultant mixture was mixed for 2 minutes at circumferential velocity of 40 m/s. Thereafter, 0.5 parts by mass of Alumina 2 was further added, and the resultant mixture was mixed for 2 minutes at circumferential velocity of 35 m/s. Then, 2 parts by mass of NX90G (available from NIPPON AEROSIL CO., LTD.) was further added, and the resultant mixture was mixed for 3 minutes at circumferential velocity of 40 m/s. The resultant mixture was passed through a sieve with a mesh size of 500, to thereby obtain a toner. Moreover, a developer was produced in the same manner as in Example 1.

Example 12

A toner was obtained in the same manner as in Example 11, except that, in <Mixing step> of Example 11, NX90G (available from NIPPON AEROSIL CO., LTD.) was not added. Moreover, a developer was produced in the same manner as in Example 1.

Example 13

A toner was obtained in the same manner as in Example 11, except that, in <Mixing step> of Example 11, the circumferential velocity and mixing duration after adding 0.5 parts by mass of Alumina 2 were changed from 35 m/s to 40 m/s and from 2 minutes to 1 minute, respectively, and the mixing duration after adding 2 parts by mass of NS90G (available from NIPPON AEROSIL CO., LTD.) was changed from 3 minutes to 14 minutes. Moreover, a developer was produced in the same manner as in Example 1.

Example 14

A toner was obtained in the same manner as in Example 11, except that, in <Mixing step> of Example 11, the mixing duration after adding 0.5 parts by mass of Alumina 2 was changed from 2 minutes to 5 minutes, and the mixing duration after adding 2 parts by mass of NS90G (available from NIPPON AEROSIL CO., LTD.) was changed from 3 minutes to 10 minutes. Moreover, a developer was produced in the same manner as in Example 1.

Example 15

A toner was obtained in the same manner as in Example 11, except that, in <Mixing step> of Example 11, the mixing duration after adding 0.5 parts by mass of Alumina 2 was changed from 2 minutes to 4 minutes, and the mixing duration after adding 2 parts by mass of NS90G (available from NIPPON AEROSIL CO., LTD.) was changed from 3 minutes to 7 minutes. Moreover, a developer was produced in the same manner as in Example 1.

Example 16

A toner was obtained in the same manner as in Example 14, except that, in <Mixing step> of Example 14, Alumina 2 was replaced with Alumina 5 prepared in the following manner. Moreover, a developer was produced in the same manner as in Example 1.

—Preparation of Alumina 5—

A reaction tank was charged with alumina having a BET specific surface area of 145 $m^2/g$ (Alu 130, available from NIPPON AEROSIL CO., LTD.). While stirring the alumina powder in a nitrogen atmosphere, a mixed solution including 10 g of heptadecafluorodecyltrimethoxysilane (KBM-7803, available from Shin-Etsu Chemical Co., Ltd.) and 2 g of hexamethyldisilazane was sprayed to 100 g of the alumna powder. The resultant was heated and stirred for 120 minutes at 200° C., followed by cooling, to thereby obtain Alumina 5.

Example 17

A developer was produced in the same manner as in Example 16, except that, in <Production of developer> of Example 16, Carrier 1 was replaced with Carrier 2 produced in the following manner.

Production Example 2 of Carrier

Twenty parts by mass (solid content: 100 parts by mass) of a methacryl-based copolymer having the weight average molecular weight (Mw) of 35,000 obtained in Resin Synthesis Example 1 above, 100 parts by mass (solid content: 20% by mass) of a silicone resin (SR2410, available from Dow Corning Toray Silicone Co., Ltd.) solution, 3.0 parts by mass (solid content: 100 parts by mass) of aminosilane, 36 parts by mass of barium sulfate particles (available from SAKAI CHEMICAL INDUSTRY CO., LTD., equivalent circle diameter: 700 nm) and 60 parts by mass of oxygen-defected tin particles (available from MITSUI MINING & SMELTING CO., LTD., primary particle diameter: 30 nm) both serving as particles, and 2 parts by mass of titanium diisopropoxybis(ethylacetoacetate) TC-750 (available from Matsumoto Fine Chemical Co., Ltd.) serving as a catalyst were diluted with toluene to thereby obtain a resin solution having a solid content of 20% by mass.

Mn ferrite particles having the weight average particle diameter of 35 μm were used as cores. The resin solution was applied onto surfaces of the cores by means of a fluid bed coater equipped with nozzles for fine granulation. The application of the resin solution was performed and the applied film was dried in the manner that the average film thickness of the resultant resin layer was to be 1.00 μm, and the temperature inside the fluid bed was controlled to be 60° C. The obtained carrier was fired in an electric furnace for 1 hour at 210° C., to thereby obtain Carrier 2.

Example 18

A toner was obtained in the same manner as in Example 16, except that, in <Mixing step>, TG-C110 (available from Cabot Specialty Chemicals Inc.) and NX90G (available from NIPPON AEROSIL CO., LTD.) were not added. Moreover, a developer was produced in the same manner as in Example 17.

Comparative Example 1

A toner was obtained in the same manner as in Example 4, except that, in <Mixing step> of Example 4, Alumina 1 was replaced with Alumina 6 prepared in the following manner. Moreover, a developer was produced in the same manner as in Example 1.

—Preparation of Alumina 6—

A reaction tank was charged with alumina having a BET specific surface area of 14.5 $m^2/g$ (TM-5D, available from TAIMEI CHEMICALS CO., LTD.). White stirring the alumina powder in a nitrogen atmosphere, a solution including 10 g of hexamethyldisilazane was sprayed to 100 g of the alumna powder. The resultant was heated and stirred for 120 minutes at 200° C., followed by cooling, to thereby obtain Alumina 6.

Comparative Example 2

A toner was obtained in the same manner as in Example 1, except that, in <Mixing step> of Example 1, the mixing duration after adding 0.5 parts by mass of Alumina 1 was changed from 3 minutes to 4 minutes, and the mixing duration after adding 2 parts by mass of NS90G (available from NIPPON AEROSIL CO., LTD.) was changed from 17 minutes to 19 minutes. Moreover, a developer was produced in the same manner as in Example 1.

Comparative Example 3

A toner was obtained in the same manner as in Example 1, except that, in <Mixing step> of Example 1, the circumferential velocity and mixing duration after adding 0.5 parts by mass of Alumina 1 were changed from 40 m/s to 35 m/s and from 3 minutes to 1 minute, respectively, and the mixing duration after adding 2 parts by mass of NS90G (available from NIPPON AEROSIL CO., LTD.) was changed from 17 minutes to 1 minute. Moreover, a developer was produced in the same manner as in Example 1.

Comparative Example 4

A toner was obtained in the same manner as in Example 1, except that, in <Mixing step> of Example 1, the circumferential velocity and mixing duration after adding 0.5 parts by mass of Alumina 1 were changed from 40 m/s to 35 m/s and from 3 minutes to 4 minutes, respectively, and the mixing duration after adding 2 parts by mass of NS90G (available from NIPPON AEROSIL CO., LTD.) was changed from 17 minutes to 10 minutes. Moreover, a developer was produced in the same manner as in Example 1.

Comparative Example 5

A toner was obtained in the same manner as in Example 1, except that, in <Mixing step> of Example 1, the circumferential velocity after adding 0.5 parts by mass of Alumina 1 was changed from 40 m/s to 30 m/s, and the mixing duration after adding 2 parts by mass of NS90G (available from NIPPON AEROSIL CO., LTD.) was changed from 17 minutes to 7 minutes. Moreover, a developer was produced in the same manner as in Example 1.

Next, the compositions of the inorganic particles of the toners and the mixing conditions are summarized in Tables 1-1 to 1-5.

TABLE 1-1

| | | Example | | | | |
|---|---|---|---|---|---|---|
| | | 1 | 2 | 3 | 4 | 5 |
| First stage | Type | — | — | — | — | — |
| | Product name | — | — | — | — | — |
| | Number average particle diameter (nm) | — | — | — | — | — |
| | Amount (mass parts) | — | — | — | — | — |
| Second stage | Type | Alumina | Alumina | Alumina | Alumina | Alumina |
| | Name | Alumina 1 | Alumina 1 | Alumina 1 | Alumina 1 | Alumina 1 |
| | Number average particle diameter (nm) | 100 | 100 | 100 | 100 | 100 |
| | Ratio (major axis diameter/minor axis diameter) | 1.5 | 1.5 | 1.5 | 1.5 | 1.5 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 40 | 40 | 40 | 35 | 35 |
| | Mixing duration (min.) | 3 | 5 | 1 | 5 | 2 |
| Third stage | Circumferential velocity (m/s) | 40 | 40 | 40 | 40 | 40 |
| | Mixing duration (min.) | 17 | 14 | 20 | 10 | 3 |

TABLE 1-2

| | | Example | | | | |
|---|---|---|---|---|---|---|
| | | 6 | 7 | 8 | 9 | 10 |
| First stage | Type | — | — | — | — | — |
| | Product name | — | — | — | — | — |
| | Number average particle diameter (nm) | — | — | — | — | — |
| | Amount (mass parts) | — | — | — | — | — |
| Second stage | Type | Alumina | Alumina | Alumina | Alumina | Alumina |
| | Name | Alumina 1 | Alumina 1 | Alumina 2 | Alumina 3 | Alumina 4 |
| | Number average particle diameter (nm) | 100 | 100 | 17 | 23 | 28 |
| | Ratio (major axis diamctcr/minor axis diameter) | 1.5 | 1.5 | 1.4 | 1.4 | 1.4 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 30 | 35 | 35 | 35 | 35 |
| | Mixing duration (min.) | 5 | 4 | 2 | 2 | 2 |
| Third stage | Circumferential velocity (m/s) | 40 | 40 | 40 | 40 | 40 |
| | Mixing duration (min.) | 7 | 1 | 3 | 3 | 3 |

TABLE 1-3

| | | Example | | | | |
|---|---|---|---|---|---|---|
| | | 11 | 12 | 13 | 14 | 15 |
| First stage | Type | Silica | Silica | Silica | Silica | Silica |
| | Product name | TG-C110 | TG-C110 | TG-C110 | TG-C110 | TG-C110 |
| | Number average particle diameter (nm) | 115 | 115 | 115 | 115 | 115 |
| | Amount (mass parts) | 2 | 2 | 2 | 2 | 2 |
| Second stage | Type | Alumina | Alumina | Alumina | Alumina | Alumina |
| | Name | Alumina 2 | Alumina 2 | Alumina 2 | Alumina 2 | Alumina 2 |
| | Number average particle diameter (nm) | 17 | 17 | 17 | 17 | 17 |
| | Ratio (major axis diametcr/minor axis diameter) | 1.4 | 1.4 | 1.4 | 1.4 | 1.4 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 1.5 | 0.5 | 0.5 | 0.5 |

TABLE 1-3-continued

| | | Example | | | | |
|---|---|---|---|---|---|---|
| | | 11 | 12 | 13 | 14 | 15 |
| Third stage | Type | Silica | — | Silica | Silica | Silica |
| | Product name | NX90G | — | NX90G | NX90G | NX90G |
| | Number average particle diameter (nm) | 20 | — | 20 | 20 | 20 |
| | Amount (mass parts) | 2 | — | 2 | 2 | 2 |
| First stage | Circumferential velocity (m/s) | 40 | 30 | 40 | 40 | 40 |
| | Mixing duration (min.) | 2 | 1 | 2 | 2 | 2 |
| Second stage | Circumferential velocity (m/s) | 35 | 40 | 40 | 35 | 35 |
| | Mixing duration (min.) | 2 | 7 | 1 | 5 | 4 |
| Third stage | Circumferential velocity (m/s) | 40 | — | 40 | 40 | 40 |
| | Mixing duration (min.) | 3 | — | 14 | 10 | 7 |

TABLE 1-4

| | | Example | | |
|---|---|---|---|---|
| | | 16 | 17 | 18 |
| First stage | Type | Silica | Silica | — |
| | Product name | TG-C110 | TG-C110 | — |
| | Number average particle diameter (nm) | 115 | 115 | — |
| | Amount (mass parts) | 2 | 2 | — |
| Second stage | Type | Alumina | Alumina | Alumina |
| | Name | Alumina 5 | Alumina 5 | Alumina 5 |
| | Number average particle diameter (nm) | 13 | 13 | 13 |
| | Ratio (major axis diameter/minor axis diameter) | 1.2 | 1.2 | 1.2 |
| | Surface treating agent 1 | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane |
| | Amount (mass parts) | 0.5 | 0.5 | 1.5 |
| Third stage | Type | Silica | Silica | — |
| | Product name | NX90G | NX90G | — |
| | Number average particle diameter (nm) | 20 | 20 | — |
| | Amount (mass parts) | 2 | 2 | — |
| First stage | Circumferential velocity (m/s) | 40 | 40 | — |
| | Mixing duration (min.) | 2 | 2 | — |
| Second stage | Circumferential velocity (m/s) | 35 | 35 | 40 |
| | Mixing duration (min.) | 5 | 5 | 10 |
| Third stage | Circumferential velocity (m/s) | 40 | 40 | — |
| | Mixing duration (min.) | 10 | 10 | — |

TABLE 1-5

| | | Comparative Example | | | | |
|---|---|---|---|---|---|---|
| | | 1 | 2 | 3 | 4 | 5 |
| First stage | Type | — | — | — | — | — |
| | Product name | — | — | — | — | — |
| | Number average particle diameter (nm) | — | — | — | — | — |
| | Amount (mass parts) | — | — | — | — | — |
| Second stage | Type | Alumina | Alumina | Alumina | Alumina | Alumina |
| | Name | Alumina 6 | Alumina 1 | Alumina 1 | Alumina 1 | Alumina 1 |
| | Number average particle diameter (nm) | 100 | 100 | 100 | 100 | 100 |
| | Ratio (major axis diameter/minor axis diameter) | 1.5 | 1.5 | 1.5 | 1.5 | 1.5 |
| | Surface treating agent 1 | — | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 35 | 40 | 35 | 35 | 30 |
| | Mixing duration (min.) | 5 | 4 | 1 | 4 | 3 |
| Third stage | Circumferential velocity (m/s) | 40 | 40 | 40 | 35 | 40 |
| | Mixing duration (min.) | 10 | 19 | 1 | 10 | 7 |

Next, various properties of each of the obtained developers were evaluated in the following manner. The results are presented in Tables 2-1 to 2-5.

<Charge Stability>

A durability test was performed by continuously outputting 100,000 sheets of an image having a letter image pattern having an image area rate of 12% using each of the developers. A change in the charge amount during the test was evaluated. A small amount of the developer on the developing sleeve was collected, and a change in the charge amount was determined by a blow-off method. The results were evaluated based on the following criteria. Note that, the result of C or better was the practically usable level.

[Evaluation criteria]

A: The change in the charge amount was less than 3 μc/g.

B: The change in the charge amount was 3 μc/g or greater but less than 6 μc/g.

C: The change in the charge amount was 6 μc/g or greater but 10 μc/g or less.

D: The change in the charge amount was greater than 10 μc/g.

<Toner Scattering>

A durability test was performed by continuously outputting 100,000 sheets of a chart having an imaging area rate of 5% using each of the developers in the environment having a temperature of 40° C., and humidity of 90% RH by means of an evaluation device obtained by modifying an image forming apparatus (IPSIO Color 8100, available from Ricoh Company Limited) to an oil-less fixing system, and tuning the apparatus. Thereafter, the state of toner contamination inside the evaluation device was observed and evaluated based on the following criteria. Note that, the result of C or better was the practically usable level.

[Evaluation Criteria]

A: No toner contamination was observed, and the inside of the device maintained an excellent state.

B: Toner contamination was slightly observed, but it was not a problematic level.

C: Toner contamination was slightly observed.

D: Significant toner contamination was observed, which was outside an acceptable range and problematic.

<Scraping of Photoconductor and Contamination of Photoconductor (Photoconductor Filming)>

Image formation was performed by means of a modified image forming apparatus (Ricoh MP C305SP, available from Ricoh Company Limited), which had been modified in a manner that a linear velocity of a developing roller inside a developing device could be variable, under the following conditions. Unless otherwise stated, the amount of the developer was 110 g, and the linear velocity of the developing roller inside the developing device was set to 266 mm/sec.

An image having an imaging area ratio of 5% and an image having an imaging area ratio of 20% were alternately output per 1,000 sheets at 23° C., and 50% RH from 0 sheets up to less than 10,000 sheets, and at 28° C. and 85% RH from 20,000 sheets up to less than 30,000 sheets. The image formation performed by the device mentioned above was performed 3 sets to output 90,000 sheets.

After completing the image formation of the 90,000 sheets above, the photoconductor was observed, and formation of an abnormal image was confirmed with a dot image, and the results were evaluated based on the following criteria. Note that, the result of C or better was the practically usable level.

The scraping of the photoconductor means a state where a scratch is formed in the photoconductor by the toner etc., and the photoconductor may be scraped along a circumferential direction in a severe case.

[Evaluation Criteria]

A: There was no scrape of the photoconductor and no contamination of the photoconductor was observed.

B: Slight contamination of the photoconductor was observed, but no defect was formed in the dot image.

C: The scraping of the photoconductor occurred, but a difference could not be detected in the dot image.

D: A scratch was formed in the photoconductor, and a difference was clearly detected in the dot image.

<Spent Ratio>

After a photocopy test of 100,000 sheets, the toner was removed from the developer by blow-off, and the weight of the remained carrier was measured and determined as W1. Next, the carrier was placed in toluene, dissolved, and washed. The resultant was dried. Thereafter, the weight thereof was measured and determined as W2. Then, a spent ratio was determined by the formula below and the spent ratio was evaluated based on the following criteria. Note that, the result of C or better was the practically usable level.

$$\text{Spent ratio}=[(W1-W2)/W1]\times 100$$

[Evaluation criteria]

A: The spent ratio was 0% by mass or greater but less than 0.01% by mass.

B: The spent ratio was 0.01% by mass or greater but less than 0.02% by mass.

C: The spent ratio was 0.02% by mass or greater but less than 0.05% by mass.

D: The spent ratio was 0.05% by mass or greater.

<Heat Resistant Storage Stability>

A 50 mL glass vessel was charged with each of the toners, the vessel was left to stand for 24 hours in a constant temperature tank of 50° C., and then the toner therein was cooled to 24° C. Next, a penetration degree (mm) was measured according to a penetration degree test (JIS K2235-1991), and the heat resistant storage stability of the toner was evaluated based on the following evaluation criteria. Note that, the result of C or better was the practically usable level.

[Evaluation Criteria]

A: The penetration degree was 20 mm or greater.

B: The penetration degree was 15 mm or greater but less than 20 mm.

C: The penetration degree was 10 mm or greater but less than 15 mm.

D: The penetration degree was less than 10 mm.

TABLE 2-1

| | | Example | | | | |
|---|---|---|---|---|---|---|
| | | 1 | 2 | 3 | 4 | 5 |
| First stage | Type | — | — | — | — | — |
| | Product name | — | — | — | — | — |
| | Number average particle diameter (nm) | — | — | — | — | — |
| | Amount (mass parts) | — | — | — | — | — |
| Second stage | Type | Alumina | Alumina | Alumina | Alumina | Alumina |
| | Name | Alumina 1 | Alumina 1 | Alumina 1 | Alumina 1 | Alumina 1 |
| | Number average particle diameter (nm) | 100 | 100 | 100 | 100 | 100 |
| | Ratio (major axis diameter/minor axis diameter) | 1.5 | 1.5 | 1.5 | 1.5 | 1.5 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 40 | 40 | 40 | 35 | 35 |
| | Mixing duration (min.) | 3 | 5 | 1 | 5 | 2 |

TABLE 2-1-continued

| | | Example | | | | |
|---|---|---|---|---|---|---|
| | | 1 | 2 | 3 | 4 | 5 |
| Third stage | Circumferential velocity (m/s) | 40 | 40 | 40 | 40 | 40 |
| | Mixing duration (min.) | 17 | 14 | 20 | 10 | 3 |
| Liberation rate (%) | Alumina | 6 | 3 | 12 | 15 | 24 |
| | Silica | 6 | 12 | 3 | 20 | 34 |
| | Inorganic particles | 12 | 15 | 15 | 35 | 58 |
| Carrier No. | | 1 | 1 | 1 | 1 | 1 |
| Evaluation results | Charge stability | C | C | C | C | C |
| | Toner scattering | C | C | C | C | C |
| | Photoconductor filming | C | C | C | C | C |
| | Spent ratio | C | C | C | C | C |
| | Heat resistant storage stability | C | C | C | C | C |

TABLE 2-2

| | | Example | | | | |
|---|---|---|---|---|---|---|
| | | 6 | 7 | 8 | 9 | 10 |
| First stage | Type | — | — | — | — | — |
| | Product name | — | — | — | — | — |
| | Number average particle diameter (nm) | — | — | — | — | — |
| | Amount (mass parts) | — | — | — | — | — |
| Second stage | Type | Alumina | Alumina | Alumina | Alumina | Alumina |
| | Name | Alumina 1 | Alumina 1 | Alumina 2 | Alumina 3 | Alumina 4 |
| | Number average particle diameter (nm) | 100 | 100 | 17 | 23 | 28 |
| | Ratio (major axis diameter/minor axis diameter) | 1.5 | 1.5 | 1.4 | 1.4 | 1.4 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 30 | 35 | 35 | 35 | 35 |
| | Mixing duration (min.) | 5 | 4 | 2 | 2 | 2 |
| Third stage | Circumferential velocity (m/s) | 40 | 40 | 40 | 40 | 40 |
| | Mixing duration (min.) | 7 | 1 | 3 | 3 | 3 |
| Liberation rate (%) | Alumina | 28 | 18 | 24 | 24 | 24 |
| | Silica | 28 | 38 | 34 | 34 | 34 |
| | Inorganic particles | 56 | 56 | 58 | 58 | 58 |

TABLE 2-2-continued

| | | Example | | | | |
|---|---|---|---|---|---|---|
| | | 6 | 7 | 8 | 9 | 10 |
| Carrier No. | | 1 | 1 | 1 | 1 | 1 |
| Evaluation results | Charge stability | C | C | B | B | B |
| | Toner scattering | C | C | C | C | C |
| | Photoconductor filming | C | C | C | C | C |
| | Spent ratio | C | C | C | C | C |
| | Heat resistant storage stability | C | C | B | B | B |

TABLE 2-3

| | | Example | | | | |
|---|---|---|---|---|---|---|
| | | 11 | 12 | 13 | 14 | 15 |
| First stage | Type | Silica | Silica | Silica | Silica | Silica |
| | Product name | TG-C110 | TG-C110 | TG-C110 | TG-C110 | TG-C110 |
| | Number average particle diameter (nm) | 115 | 115 | 115 | 115 | 115 |
| | Amount (mass parts) | 2 | 2 | 2 | 2 | 2 |
| Second stage | Type | Alumina | Alumina | Alumina | Alumina | Alumina |
| | Name | Alumina 2 | Alumina 2 | Alumina 2 | Alumina 2 | Alumina 2 |
| | Number average particle diameter (nm) | 17 | 17 | 17 | 17 | 17 |
| | Ratio (major axis diameter/minor axis diameter) | 1.4 | 1.4 | 1.4 | 1.4 | 1.4 |
| | Surface treating agent 1 | Heptadecafluorodecyl trimethoxysilane | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 1.5 | 0.5 | 0.5 | 0.5 |
| Third stage | Type | Silica | — | Silica | Silica | Silica |
| | Product name | NX90G | — | NX90G | NX90G | NX90G |
| | Number average particle diameter (nm) | 20 | — | 20 | 20 | 20 |
| | Amount (mass parts) | 2 | — | 2 | 2 | 2 |
| First stage | Circumferential velocity (m/s) | 40 | 30 | 40 | 40 | 40 |
| | Mixing duration (min.) | 2 | 1 | 2 | 2 | 2 |
| Second stage | Circumferential velocity (m/s) | 35 | 40 | 40 | 35 | 35 |
| | Mixing duration (min.) | 2 | 7 | 1 | 5 | 4 |
| Third stage | Circumferential velocity (m/s) | 40 | — | 40 | 40 | 40 |
| | Mixing duration (min.) | 3 | — | 14 | 10 | 7 |
| Liberation rate (%) | Alumina | 24 | 28 | 12 | 15 | 18 |
| | Silica | 34 | 25 | 12 | 20 | 28 |
| | Inorganic particles | 58 | 53 | 24 | 35 | 46 |
| Carrier No. | | 1 | 1 | 1 | 1 | 1 |
| Evaluation results | Charge stability | B | C | B | B | B |
| | Toner scattering | B | C | B | B | B |
| | Photoconductor filming | C | C | B | A | B |
| | Spent ratio | C | C | B | A | B |
| | Heal resistant storage stability | B | B | B | A | A |

TABLE 2-4

| | | Example | | |
|---|---|---|---|---|
| | | 16 | 17 | 18 |
| First stage | Type | Silica | Silica | — |
| | Product name | TG-C110 | TG-C110 | — |
| | Number average particle diameter (nm) | 115 | 115 | — |
| | Amount (mass parts) | 2 | 2 | — |
| Second stage | Type | Alumina | Alumina | Alumina |
| | Name | Alumina 5 | Alumina 5 | Alumina 5 |
| | Number average particle diameter (nm) | 13 | 13 | 13 |
| | Ratio (major axis diameter/minor axis diameter) | 1.2 | 1.2 | 1.2 |
| | Surface treating agent 1 | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane |
| | Amount (mass parts) | 0.5 | 0.5 | 1.5 |
| Third stage | Type | Silica | Silica | — |
| | Product name | NX90G | NX90G | — |
| | Number average particle diameter (nm) | 20 | 20 | — |
| | Amount (mass parts) | 2 | 2 | — |
| First stage | Circumferential velocity (m/s) | 40 | 40 | — |
| | Mixing duration (min.) | 2 | 2 | — |
| Second stage | Circumferential velocity (m/s) | 35 | 35 | 40 |
| | Mixing duration (min.) | 5 | 5 | 10 |
| Third stage | Circumferential velocity (m/s) | 40 | 40 | — |
| | Mixing duration (min.) | 10 | 10 | — |
| Liberation rate (%) | Alumina | 15 | 15 | 18 |
| | Silica | 20 | 20 | — |
| | Inorganic particles | 35 | 35 | 18 |
| Carrier No. | | 1 | 2 | 2 |
| Evaluation results | Charge stability | B | A | C |
| | Toner scattering | B | A | C |
| | Photoconductor filming | A | A | C |
| | Spent ratio | A | A | B |
| | Heat resistant storage stability | A | A | B |

TABLE 2-5

| | | Comparative Example | | | | |
|---|---|---|---|---|---|---|
| | | 1 | 2 | 3 | 4 | 5 |
| First stage | Type | — | — | — | — | — |
| | Product name | — | — | — | — | — |
| | Number average particle diameter (nm) | — | — | — | — | — |
| | Amount (mass parts) | — | — | — | — | — |

TABLE 2-5-continued

| | | Comparative Example | | | | |
|---|---|---|---|---|---|---|
| | | 1 | 2 | 3 | 4 | 5 |
| Second stage | Type | Alumina | Alumina | Alumina | Alumina | Alumina |
| | Name | Alumina 6 | Alumina 1 | Alumina 1 | Alumina 1 | Alumina 1 |
| | Number average particle diameter (nm) | 100 | 100 | 100 | 100 | 100 |
| | Ratio (major axis diameter/minor axis diameter) | 1.5 | 1.5 | 1.5 | 1.5 | 1.5 |
| | Surface treating agent 1 | — | Heptadecafluorodecyl trimethoxysilane | Heptadecafluorodecyl trimethoxysilane | Heptadecafluorodecyl trimethoxysilane | Heptadecafluorodecyl trimethoxysilane |
| | Surface treating agent 2 | Hexamethyldisilazane | Hexamethyldisilazane | Hexamethyldisilazane | Hexamethyldisilazane | Hexamethyldisilazane |
| | Amount (mass parts) | 0.5 | 0.5 | 0.5 | 0.5 | 0.5 |
| Third stage | Type | Silica | Silica | Silica | Silica | Silica |
| | Product name | NX90G | NX90G | NX90G | NX90G | NX90G |
| | Number average particle diameter (nm) | 20 | 20 | 20 | 20 | 20 |
| | Amount (mass parts) | 2 | 2 | 2 | 2 | 2 |
| First stage | Circumferential velocity (m/s) | — | — | — | — | — |
| | Mixing duration (min.) | — | — | — | — | — |
| Second stage | Circumferential velocity (m/s) | 35 | 40 | 35 | 35 | 30 |
| | Mixing duration (min.) | 5 | 4 | 1 | 4 | 3 |
| Third stage | Circumferential velocity (m/s) | 40 | 40 | 40 | 35 | 40 |
| | Mixing duration (min.) | 10 | 19 | 1 | 10 | 7 |
| Liberation rate (%) | Alumina | 15 | 4 | 26 | 18 | 34 |
| | Silica | 20 | 4 | 38 | 44 | 28 |
| | Inorganic particles | 35 | 8 | 64 | 62 | 62 |
| Carrier No. | | 1 | 1 | 1 | 1 | 1 |
| Evaluation results | Charge stability | D | D | D | D | D |
| | Toner scattering | D | D | D | D | D |
| | Photoconductor filming | D | D | D | D | D |
| | Spent ratio | D | D | D | D | D |
| | Heat resistant storage stability | D | D | B | B | B |

It was found from the results of Tables 2-1 to 2-5 that Examples 1 to 18 had the excellent charge stability, toner scattering, photoconductor filming, spent ratio, and heat resistant stability, compared to Comparative Examples 1 to 5.

In Comparative Example 1, on the other hand, chargeability was low, and the undesirable results of the charge stability and toner scattering were obtained because Alumina 6 to which the fluorosilane treatment had not been performed was used. Moreover, the results of the photoconductor filming, the spent ratio, and the heat resistant storage stability were not desirable.

In Comparative Example 2, the abrasiveness was low and therefore the results of photoconductor filming and spent ratio were not desirable because the liberation ratio of Alumina 1 and the liberation ratio of the silica were low, which were 4% and 4%, respectively. Moreover, the functions of the external additives were degraded because of an increase in the adhesion of the toner due to embedment of the external additive in the toner base particles or reduction in a covering rate with the external additives, and therefore the chargeability was decreased and the undesirable results of the charge stability and toner scattering were obtained. Furthermore, the results of the photoconductor filming, spent ratio, and heat resistant storage stability were not desirable.

In Comparative Example 3, the abrasiveness was excessively high and therefore the undesirable results of the photoconductor film and spent ratio were obtained because the liberation ratio of Alumina 1 and the liberation ratio of the silica were too high, which were 26% and 38%, respectively. Since the external additives were detached from the toner base particles, the results of the charge stability and toner scattering were not desirable.

In Comparative Example 4, the liberation ratio of the alumina was within the range specified in Claim 3, i.e., 18%, but the liberation ratio of the silica was too high, i.e., 44%. As a result, the liberation ratio of the inorganic particles was too high, i.e., 62%. In this case, the results were similar to the results of Comparative Example 3.

In Comparative Example 5, the liberation ratio of the silica was within the range specified in Claim 6, i.e., 28%, but the liberation ratio of the alumina was too high, i.e., 34%. As a result, the liberation ratio of the inorganic particles was too high, i.e., 62%. In this case, the results were similar to the results of Comparative Example 3.

For example, embodiments of the present disclosure are as follows.

<1> A toner including:

toner particles, each toner particle including:

a toner base particle; and inorganic particles, wherein the inorganic particles include particles of a fluorine-containing aluminium compound, and a liberation ratio of the inorganic particles is 10% or greater but 60% or less.

<2> The toner according to <1>, wherein a liberation ratio of the particles of the fluorine-containing aluminium compound is 10% or greater but 20% or less.

<3> The toner according to <1> or <2>, wherein the inorganic particles include particles of a silicon compound, and a liberation ratio of the particles of the silicon compound is 10% or greater but 30% or less.

<4> The toner according to any one of <1> to <3>, wherein a number average particle diameter of the particles of the fluorine-containing aluminium compound is 10 nm or greater but 30 nm or less.

<5> The toner according to any one of <1> to <4>, wherein a ratio (major axis diameter/minor axis diameter) of of a major axis diameter of each the particles of the fluorine-containing aluminium compound to a minor axis diameter of each of the particles of the fluorine-containing aluminium compound is 1.0 or greater but 1.3 or less.

<6> The toner according to <3>, wherein the inorganic particles include the particles of the silicon compound having a number average particle diameter of 50 nm or greater but 200 nm or less.

<7> A toner stored unit including:

a unit; and the toner according to any one of <1> to <6> stored in the unit.

<8> A developer including:

the toner according to any one of <1> to <6>; and a carrier.

<9> The developer according to <8>, wherein the carrier includes carrier particles, and each of the carrier particles include a core and a resin layer covering the core.

<10> A developer stored unit including:

a container; and the developer according to claim <8> or <9> stored in the container.

<11> An image forming apparatus including:

an electrostatic latent image bearing member;

a charging unit configured to charge the electrostatic latent image bearing member;

an exposing unit configured to expose the charged electrostatic latent image bearing member to light to form an electrostatic latent image; and a developing unit containing the developer according to <8> or <9> and configured to develop the electrostatic latent image formed on the electrostatic latent image bearing member with the developer to form a toner image.

<12> An image forming method including:

charging an electrostatic latent image bearing member;

exposing the charged electrostatic latent image bearing member to light to form an electrostatic latent image; and developing the electrostatic latent image formed on the electrostatic latent image bearing member with the developer according to <8> or <9> to form a toner image.

The toner according to any one of <1> to <6>, the toner stored unit according to <7>, the developer according to <8> or <9>, the developer stored unit according to <10>, the image forming apparatus according to <11>, and the image forming method according to <12> can solve the above-described various problems existing in the art and can achieve the object of the present disclosure.

What is claimed is:

1. A toner, comprising:

toner particles, each toner particle including a toner base particle, and inorganic particles, wherein the inorganic particles include particles of a fluorine-containing aluminium compound, and a liberation ratio of the inorganic particles is 10% or greater but 60% or less.

2. The toner according to claim 1, wherein a liberation ratio of the particles of the fluorine-containing aluminium compound is 10% or greater but 20% or less.

3. The toner according to claim 1, wherein the inorganic particles include particles of a silicon compound, and a liberation ratio of the particles of the silicon compound is 10% or greater but 30% or less.

4. The toner according to claim 3, wherein the inorganic particles include the particles of the silicon compound having a number average particle diameter of 50 nm or greater but 200 nm or less.

5. The toner according to claim 1, wherein a number average particle diameter of the particles of the fluorine-containing aluminium compound is 10 nm or greater but 30 nm or less.

6. The toner according to claim 1, wherein a ratio (major axis diameter/minor axis diameter) of a major axis diameter of each of the particles of the fluorine-containing aluminium compound to a minor axis diameter of each of the particles of the fluorine-containing aluminium compound is 1.0 or greater but 1.3 or less.

7. A toner storage device comprising:

a storage device; and the toner according to claim 1 stored in the storage device.

8. The image forming apparatus of claim 1, wherein the inorganic particles include particles of a silicon compound, and a liberation ratio of the particles of the silicon compound is 10% or greater but 30% or less.

9. A developer comprising:

a toner; and a carrier, wherein the toner includes toner particles, each toner particle including a toner base particle, and inorganic particles, and wherein the inorganic particles include particles of a fluorine-containing aluminium compound, and a liberation ratio of the inorganic particles is 10% or greater but 60% or less.

10. The developer according to claim 9, wherein the carrier includes carrier particles, and each of the carrier particles include a core and a resin layer covering the core.

11. A developer storage device, comprising:

a container; and the developer according to claim 9 stored in the container.

12. An image forming apparatus comprising:

an electrostatic latent image bearing member;

a charging unit configured to charge the electrostatic latent image bearing member;

an exposing unit configured to expose the charged electrostatic latent image bearing member to light to form an electrostatic latent image; and a developing unit containing a developer and configured to develop the electrostatic latent image formed on the electrostatic latent image bearing member with the developer to form a toner image, wherein the developer includes a toner and a carrier, wherein the toner includes toner particles, each toner particle including a toner base particle, and inorganic particles; and wherein the inorganic particles include particles of a fluorine-containing aluminium compound, and a liberation ratio of the inorganic particles is 10% or greater but 60% or less.

* * * * *